US010420973B2

(12) United States Patent
Andon

(10) Patent No.: US 10,420,973 B2
(45) Date of Patent: Sep. 24, 2019

(54) TRAMPOLINES

(71) Applicant: Vuly Parks IP Holdings Pty Ltd., Wakerley (QLD (AU)

(72) Inventor: Joe Andon, Wakerley (AU)

( * ) Notice: Subject to any disclaimer, the term of this patent is extended or adjusted under 35 U.S.C. 154(b) by 378 days.

(21) Appl. No.: 15/349,109

(22) Filed: Nov. 11, 2016

(65) Prior Publication Data

US 2017/0120094 A1 May 4, 2017

Related U.S. Application Data

(62) Division of application No. 14/124,491, filed as application No. PCT/AU2012/000651 on Jun. 7, 2012, now Pat. No. 9,492,698.

(30) Foreign Application Priority Data

| | | |
|---|---|---|
| Jun. 9, 2011 | (AU) | 2011902285 |
| Nov. 22, 2011 | (AU) | 2011904866 |
| Dec. 16, 2011 | (AU) | 2011905244 |
| Dec. 19, 2011 | (AU) | 2011905290 |
| Mar. 16, 2012 | (AU) | 2012901066 |

(51) Int. Cl.

| | |
|---|---|
| ***A63B 5/11*** | (2006.01) |
| ***A63B 71/02*** | (2006.01) |
| ***A63B 21/02*** | (2006.01) |

(52) U.S. Cl.

CPC ..... *A63B 5/11* (2013.01); *A63B 21/026* (2013.01); *A63B 71/02* (2013.01); *A63B 71/022* (2013.01); *A63B 2210/50* (2013.01)

(58) Field of Classification Search

CPC ..... A63B 5/11

See application file for complete search history.

(56) References Cited

U.S. PATENT DOCUMENTS

| | | | | |
|---|---|---|---|---|
| 6,663,538 | B2 * | 12/2003 | Yoon | A63B 5/11 482/27 |
| 2014/0336005 | A1 * | 11/2014 | Miller | A63B 5/11 482/27 |

* cited by examiner

*Primary Examiner* — Jennifer M Deichl

(57) ABSTRACT

A trampoline including: a frame adapted to rest on the ground or be mounted on a plurality of spaced apart legs; a plurality of spaced apart flexible and resilient plates extending upwards from said frame and connected thereto against relative movement therebetween; and a jumping mat operatively connected to said plates above said frame for movement with said plates upon a person jumping thereon.

5 Claims, 37 Drawing Sheets

TRAMPOLINES

CROSS-REFERENCE TO RELATED APPLICATIONS

This application is a divisional application of Ser. No. 14/124,491 filed 7 Jun. 2012, which in turn is a National Phase entry of PCT/AU2012/000651, filed 7 Jun. 2012 which claims the priority of Australian Patent Application No. 2011902285 filed 9 Jun. 2011, Australian patent Application No. 2011904866 filed 22 Nov. 2011, Australian Patent Application No. 2011905244 filed 16 Dec. 2011, Australian Patent Application No. 2011905290 filed 19 Dec. 2011, and Australian Patent Application No. 2012901066 filed 16 Mar. 2012, all of which are incorporated herein by reference.

TECHNICAL FIELD

This invention relates to trampolines. The invention has particular application to recreational trampolines of the type used in playgrounds and homes but it may have application to sporting trampolines as well.

BACKGROUND

For many years recreational trampolines have typically included a tubular steel frame which is supported on spaced legs with a flexible jumping mat secured to the frame by a large number of spaced apart extension springs which extend and contract as a person jumps on the mat in order to give "bounce." The springs are usually connected to the tubular steel frame at one end via radial slots provided therein and to the mat via hooks or the like at the other end. Although trampolines can be made in many shapes, circular is probably the most popular in which case the frame is generally constructed of arcuate segments of round tube which are joined together in a spigot and socket arrangement with the end portion of one segment sliding into the end portion of the adjacent segment.

It will be appreciated that the space between the jumping mat and the frame creates some difficulties for users in getting onto the mat, and when jumping on the mat the springs and the spaces therebetween can present some danger for anyone jumping too close to the edge of the mat. Consequently, modern recreational trampolines typically include a padded safety barrier (or "padding") extending about the mat and covering the springs and the spaces therebetween. The padding is typically tied to the mat and/or the frame by ribbon ties or the like. Such trampolines typically include a safety barrier (or "net") extending about the mat frame and attached to posts upstanding therefrom to prevent users from falling off the trampoline.

Other forms of trampolines known as "soft edged trampolines" which do not require a frame about the edge of the jumping mat and do not use extension springs to support the mat have been developed in recent years. In such trampolines, the mat is typically supported on a large number of circumferentially spaced fibreglass rods which extend upwards, outwards and forwards around the mat from a frame under the mat and are connected to the edge of the mat at their upper ends. The rods are flexible and resilient so as to bend downwards and inwards as a person's weight comes onto the mat during jumping and to return to the original position as the weight comes off the mat causing a back and forth twisting motion of the mat. Such twisting action gives a different performance feel to users.

The present invention is aimed at providing another type of trampoline which is reliable and efficient in use and which does not require extension springs to secure the jumping mat to the frame. The invention is also aimed at providing a trampoline which maintains the traditional feel of a trampoline more satisfactorily than presently known soft edged trampolines. The invention is also aimed at providing a trampoline which can be efficiently manufactured.

SUMMARY

With the foregoing in view, the invention in one aspect resides broadly in a trampoline including:

a frame adapted to rest on the ground or be mounted on a plurality of spaced apart legs;

a plurality of spaced apart flexible and resilient plates extending upwards from said frame and connected thereto against relative movement therebetween; and a jumping mat operatively connected to said plates above said frame for movement with said plates upon a person jumping thereon.

In one form of the invention a flexible and resilient rod or tube extends about the periphery of the jumping mat and is connected thereto for movement therewith and is also operatively connected to said plates for movement therewith. Such rod or tube may be in the form of connected or unconnected (or disconnected) segments in which form it is preferred that the segments be connected to the plates at about their mid-points so that each segment extends the same distance beyond both sides of the plate to which it is connected. When in the form of connected segments, the connection ideally allows for relative movement between segments as the mat moves up and down while a user is jumping thereon. In one such form, the mat is connected to a plurality of unconnected rod segments extending about its periphery so as to more or less form a circle and those rod segments are in turn connected to adjacent rod segments forming another circle outside the first circle and those segments are in turn connected to said-flexible and resilient plates. In one preferred form, the connection between the adjacent segments is via rigid coupling members while in another form they are via semi-rigid coupling members adapted to accommodate relative up and down and in and out relative movement between adjacent segments as well as some relative twisting movement.

In another aspect, the invention resides broadly in a trampoline including:

a frame adapted to rest on the ground or be mounted on a plurality of spaced apart legs;

a plurality of spaced apart flexible and resilient plates extending upwards from said frame and connected thereto against relative movement therebetween;

a jumping mat operatively connected to said plates about its perimeter above said frame, said plates being arranged for movement inwards and outwards towards and away from the opposite side of said mat in response to a user jumping on said mat.

Preferably, said plates are sized so as to bend generally in only one direction, for example, in the case of a circular mat, the plates would only bend radially inwards and outwards, while in the case of a square mat the plates would bend directly towards the opposite side of the mat. In a preferred form, the plates each comprise laminated elongate layers of spring steel over a substantial portion of its length. In one such form selected to meet desired rebound characteristics for the mat the plate comprises different numbers of layers at different places along the length of the plate.

Preferably, said spaced apart plates are connected to said frame by passing through spaced apart slots formed in said frame, the slots being suitably sized to form a tight fit about the lower end portions of the plates so as to prevent any significant relative movement therebetween. In such form, it is preferred that retaining means be provided to retain the plates in the slots.

In this form of the invention it is preferred that the mat be connected to the plates adjacent their upper ends by connector assemblies incorporating a hook and a load bearing fitting mounted in a pocket formed in the mat adjacent its periphery. In such form, it is preferred that the hook be connected at one end to the mat via the load bearing fitting and to the plates at the other and via one or more hook openings formed in the plate adjacent its upper end.

Preferably, the flexible and resilient plates are spaced apart by a predetermined distance selected to achieve a desired mat performance. In a preferred form the distance "L" between adjacent plates at the point of connection of the mat is about 200 mm or less in the case of square or rectangular trampolines and the same for the chord distance between adjacent points of connection for circular, elliptical or ovaloid trampolines. In the case of circular trampolines, the distance L is taken to be the chord distance between adjacent connection points and can be calculated according to the equation L=nD/n where n is the number of plates or connection points, D is the Diameter of the trampoline mat and n is the ratio of the circumference to its diameter and is usually rounded to 3.1428.

Preferably, the frame comprises a plurality of interconnected tubular segments suitably sized for transport of the trampoline in knock-down form. Advantageously, such segments are connected in a manner so as to prevent relative rotational or pivoting movement therebetween. In that respect, it is preferred that the frame segments include keying means for keying them together against relative rotational movement. In a preferred form, the keying means is achieved by constructing the frame segments of square hollow section tube and having the and portions of adjacent segments drawn so that the end portion of one segment fits into the end portion of an adjacent segment.

In another aspect, the invention resides broadly in a trampoline including:

a frame adapted to rest on the ground or be mounted on spaced apart legs;

a plurality of spaced apart flexible and resilient plates mounted to said frame against relative movement therebetween and extending upwards therefrom;

a jumping mat operatively connected to said plates about its perimeter above said frame, said plates being arranged for movement inwards and outwards towards and away from the opposite side of said mat respectively, in response to a user jumping on said mat, and wherein said frame is a hollow section tube of rectangular cross section with a plurality of spaced apart slots therein and the lower end portions of said plates are mounted in respective slots.

In another aspect, the invention resides broadly in the combination of a frame for a trampoline and a plurality of elongate flexible and resilient plates adapted to support a jumping mat connected thereto at their upper ends, the frame including a hollow section tube of rectangular cross section with a plurality of spaced apart slots therein and wherein the lower end portions of said plates are mounted in respective slots.

Preferably, at least some of the plates include a foot or root portion at their lower ends, the foot including a toe portion adapted to engage an inside corner of the hollow section tube. It is also preferred that the foot or foot portion include stop means adapted to engage with the inside face of the upper wall of the tube to prevent the leaf spring escaping therefrom. In a preferred form, the foot is a steel angle bend secured to the lower end portion of the leaf spring.

In such form, it is preferred that the slots be slightly wider than the thickness of the plate near the lower end so that the end portion can be fitted to the frame through the slot by firstly placing the toe portion into the slot and then rotating the leaf spring about the outer edge of the slot.

In still yet another aspect, the invention resides broadly in a trampoline including:

a frame forming a substantially continuous horizontal ring adapted to rest on the ground or above the ground on spaced apart legs;

a plurality of spaced apart flexible and resilient plates mounted to said frame against undesired relative movement therebetween and extending upwardly therefrom;

a jumping mat operatively connected to said plates about its perimeter above said frame, each of said plates being arranged for movement inwards and outwards towards and away from the opposite side of said mat respectively in response to a user jumping on said mat, and wherein said frame comprises a plurality of segments of hollow section tube with adjacent segments connected end to end by separate segment connectors adapted to engage therein.

Preferably, said segment connectors are adapted to support the frame immediately above the ground (or other suitable foundation on which the trampoline is to be placed). For that purpose it is preferred that each segment connector include a frame support portion adapted to engage the ground and two opposed frame engagement portions extending sideways therefrom for engagement in the hollow of the opposed adjacent frame segments. In a particularly preferred form, the frame support portion is symmetrical about a vertical axis through the centre of the frame support portion. It is also preferred that the frame engagement portions include means for fastening the adjacent frame segments thereto. In a preferred form, such means include threaded bores adapted to screwthreadedly receive therein bolts extending through aligned holes formed in the adjacent frame segments. In a particularly preferred form, each frame engagement portion includes at least two vertically spaced threaded bores adjacent the outer ends thereof. In one embodiment in which the segment connector is formed from cast aluminium alloy, the bores are provided in inserts formed of a stronger metal such as steel which are fitted in suitable recesses provided in the cast alloy. However, in other embodiments where the connectors are made of cast iron or steel, the threaded borers can be formed directly therein. Advantageously, the threaded connectors provides for the bolts to extend through only one wall of the frame segments so that the bolt heads will be exposed on only the inner side of the frame. It is also preferred that the frame engagement portions have slots or recesses for accommodating therein the lower ends of the flexible and resilient plates adjacent the ends of the respective frame segments connected thereto.

Preferably, said segment connectors include pole mounting means for mounting thereto poles adapted to support a safety net about the trampoline. In a preferred form, such pole mounting means includes a cavity in the segment connector adapted to slidably receive therein a net pole from above whereby a net pole can be pushed into the cavity from about so that it stands up from the frame. In a preferred form the cavity is arranged such that an elongate tubular net pole extends upwardly and slightly outwardly away from the jumping mat so that the safety net can be connected to the net pole above and outwardly beyond the mat.

Preferably, said hollow section tube is of rectangular cross section with the major axis vertical and the minor axis horizontal with a plurality of spaced apart slots therein provided in the upper wall of the tube and the lower end portions of said plates mounted in respective ones of the slots. In such form of the invention it is preferred that the frame engagement portions be of a complementary cross section adapted to slide neatly into the end portions of the frame segments.

In still yet another aspect, the invention resides broadly in a frame segment connector including:

a frame support portion adapted to engage the ground;

two opposed frame segment engagement portions extending sideways from said frame support portion for engagement in the hollow of opposed adjacent frame segments and including means for fastening adjacent frame segments thereto said means including threaded bores adapted to screwthreadedly receive therein bolts extending through aligned holes formed in the adjacent frame segments.

Preferably, the frame segment connector is symmetrical about a vertical axis through the centre of the frame support portion.

Preferably, each frame segment engagement portion includes at least two vertically spaced threaded bores adjacent the outer ends thereof.

Preferably, the frame segment engagement portions have slots or recesses for accommodating therein the lower ends of the flexible and resilient plates adjacent the ends of the respective frame segments connected thereto.

Preferably, the frame support portion has a cavity adapted to slidably receive therein a net pole from above.

Terms such as "horizontal", "vertical", "upwards", "downwards", "above", "below" and similar terms as used herein are for the purpose of describing the invention in its normal in-use orientation and are not intended to limit the invention to any particular orientation.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
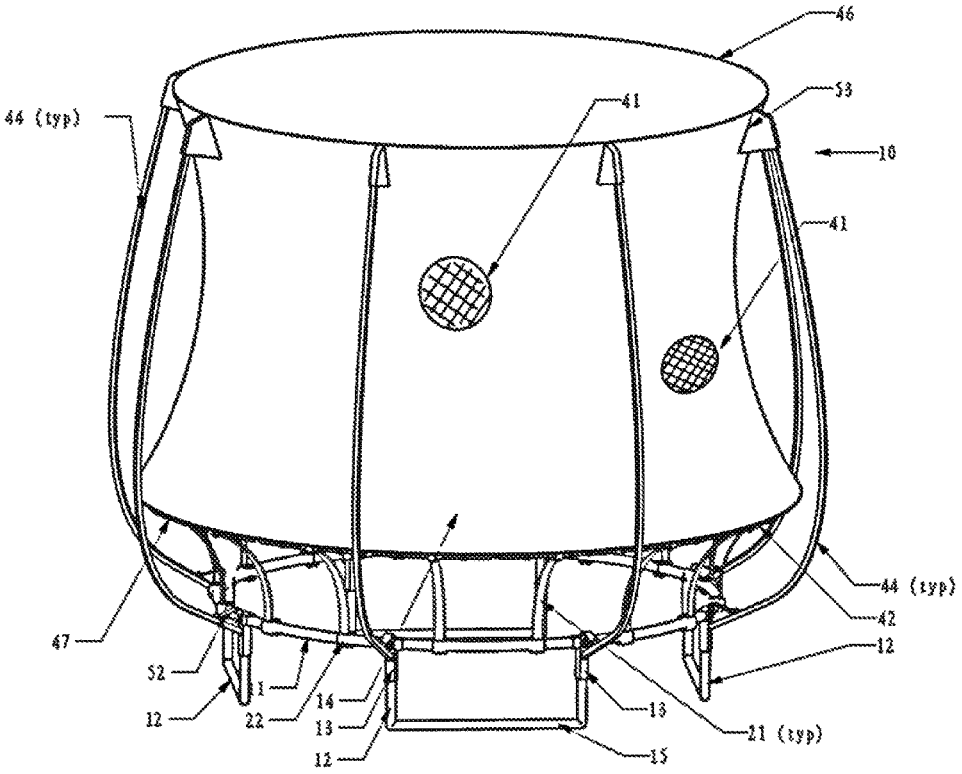
FIG. 1 is a pictorial representation of a trampoline according to the invention.
Figure 2:
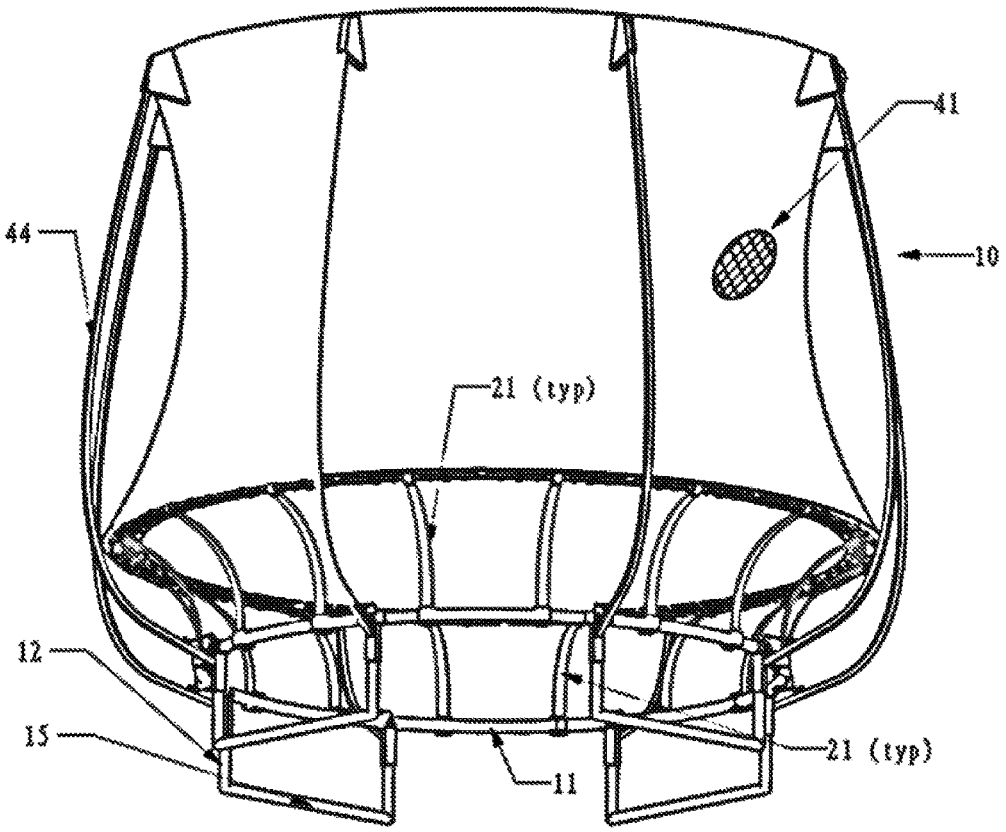
FIG. 2 is a pictorial representation of the trampoline of FIG. 1 with the mat removed for clarity.
Figure 3:
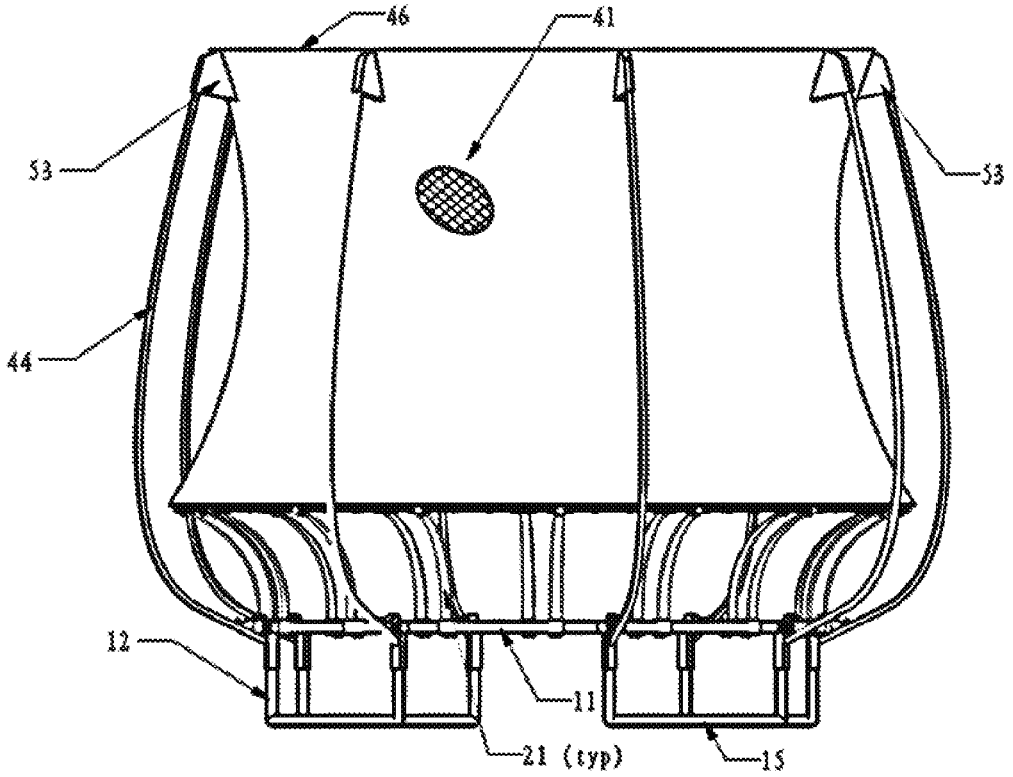
FIG. 3 is a front elevation of the trampoline of FIG. 1.
Figure 4:
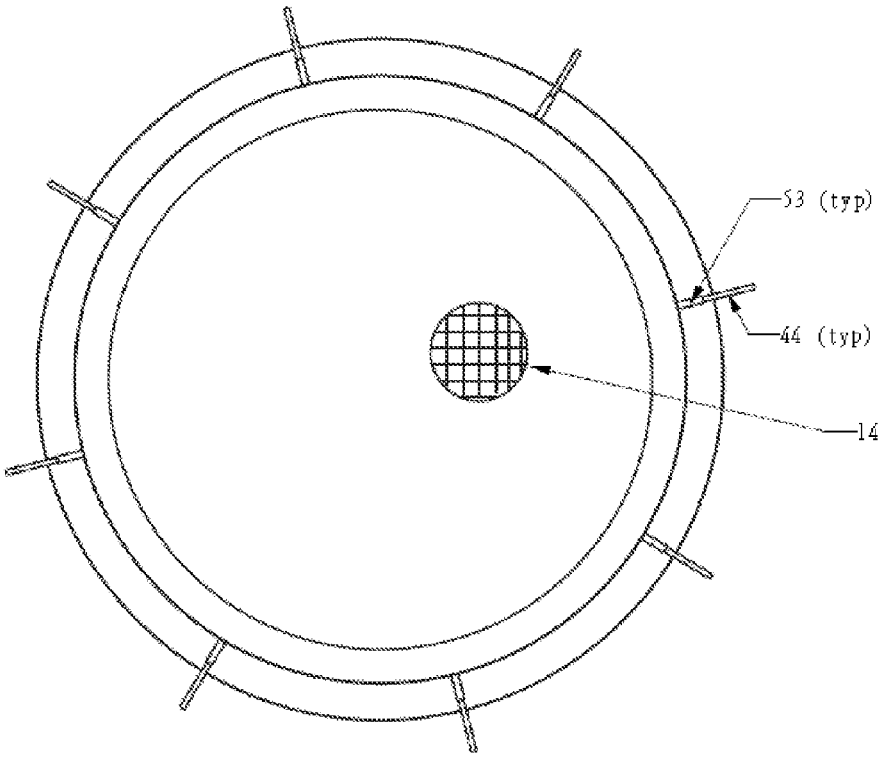
FIG. 4 is a top plan of the trampoline of FIG. 1.

The trampoline 10 illustrated in FIG. 1 includes an elevated circular bottom, frame 11 constructed of 65 mm round steel tube which is supported on eight angularly spaced legs 12 each of which is connected to the frame by opposed leg mounts 13 and pairs of adjacent legs are connected by a horizontal member at their lower ends. Suitably, a jumping mat 14 is operatively connected to the frame 11 via sixteen equally angularly spaced leaf springs 21 which extend upwardly and curve outwardly from the frame.

Figure 11:
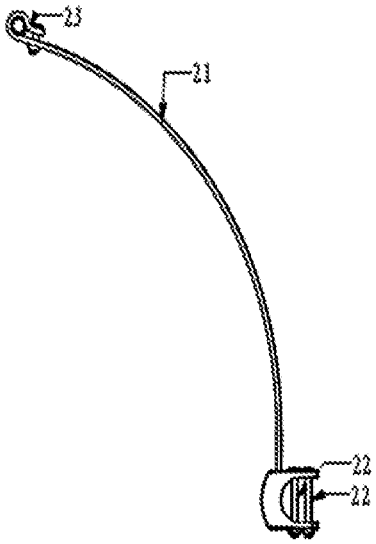
FIG. 11 is an end elevation of the leaf spring component of FIG. 10.
Figure 12:
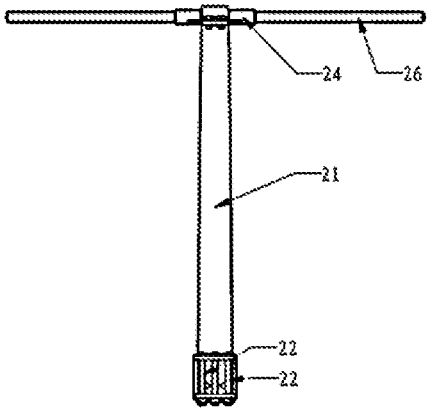
FIG. 12 is a front elevation of the leaf spring component of FIG. 10.
Figure 13:
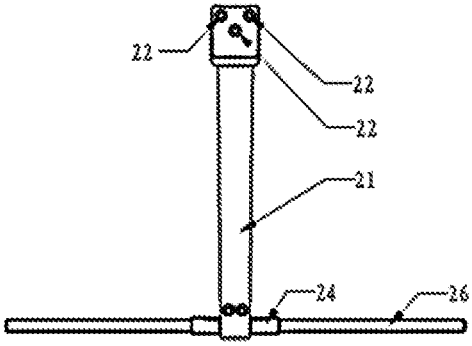
FIG. 13 is a rear elevation of the leaf spring component of FIG. 10.

The leaf springs 21 are rigidly secured to the frame by three bolts 22 which pass through suitable bolt holes formed in the frame. As can be seen in FIG. 11, the upper end of the leaf spring is folded back on itself to form a saddle clamp 23 which wraps around a short steel tube 24 in which a segment of fibreglass rod 26 is fitted and secured therein by a suitable flexible adhesive as can be seen in FIGS. 10 to 13.

Figure 5:
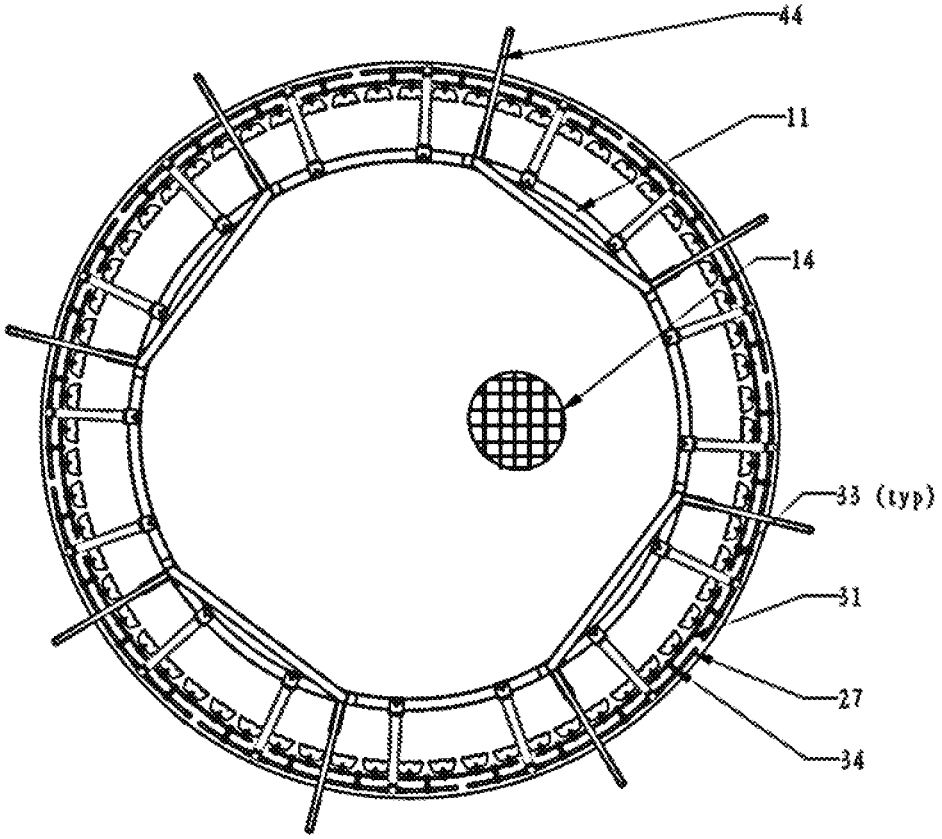
FIG. 5 is a bottom plan of the trampoline of FIG. 1.
Figure 6:
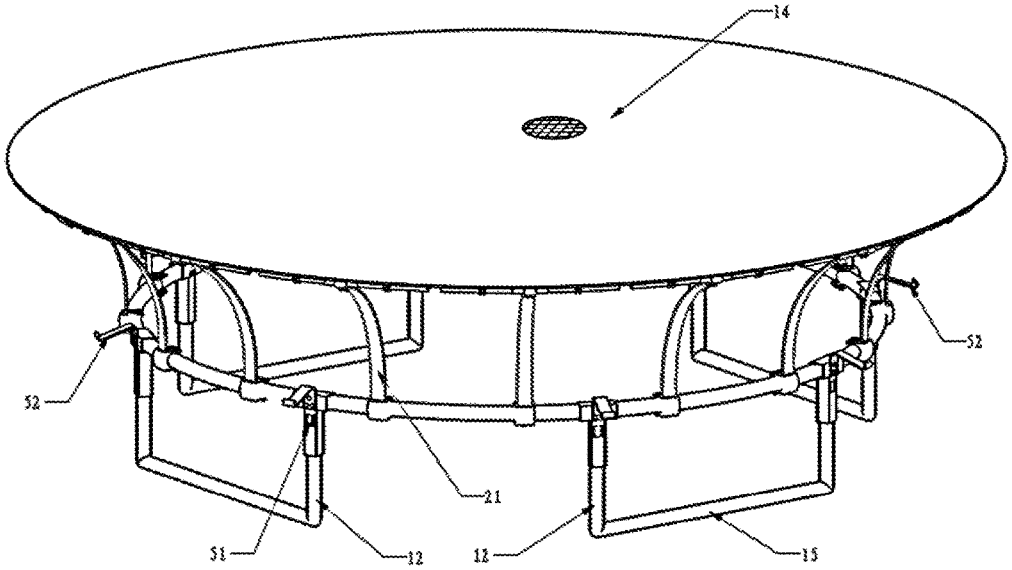
FIG. 6 is a plan of the trampoline of FIG. 1 with the net removed for clarity.
Figure 7:
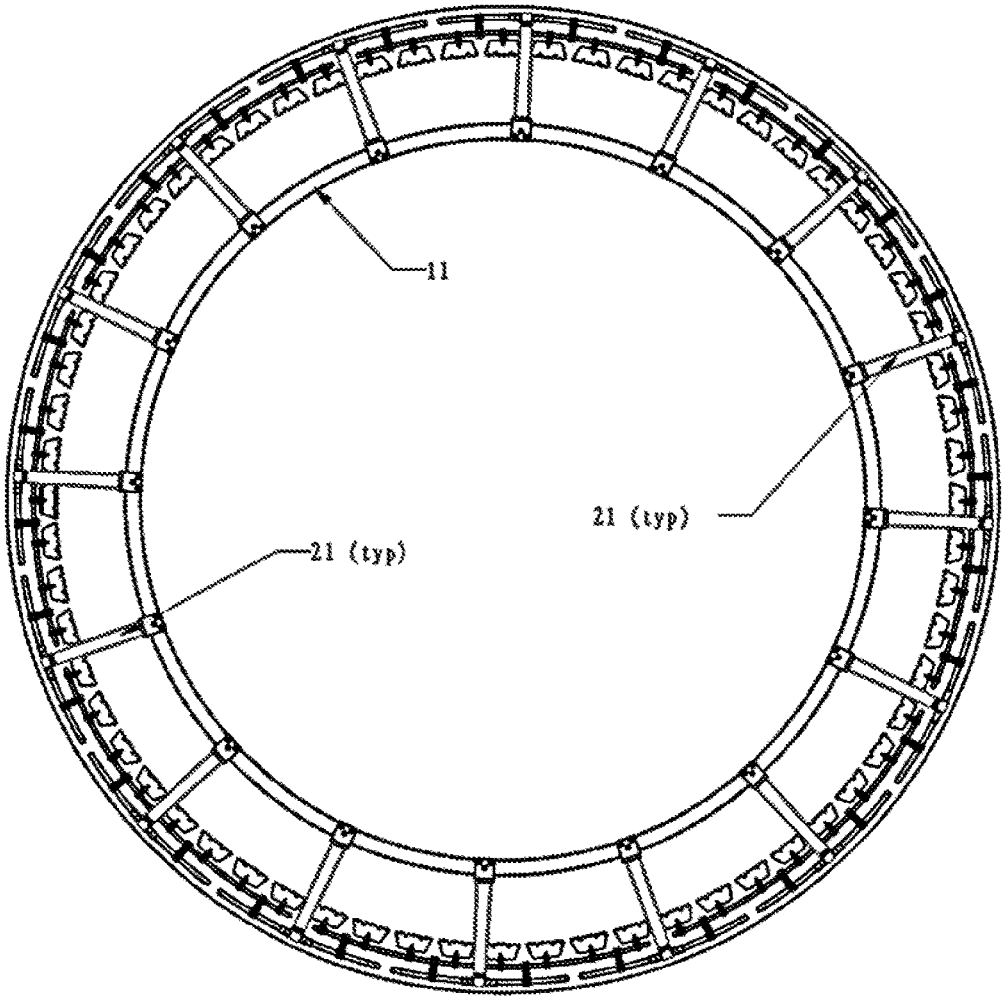
FIG. 7 is a bottom plan of the trampoline of FIG. 1 with net and legs removed.
Figure 8:
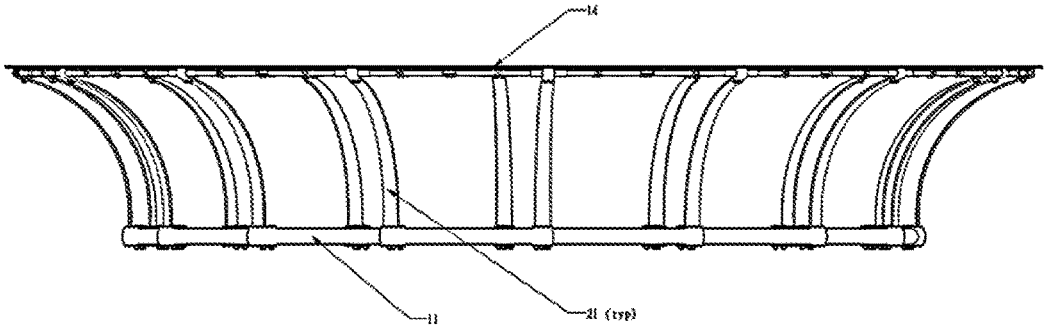
FIG. 8 is an elevation of the trampoline of FIG. 1 with net and legs removed.
Figure 9:
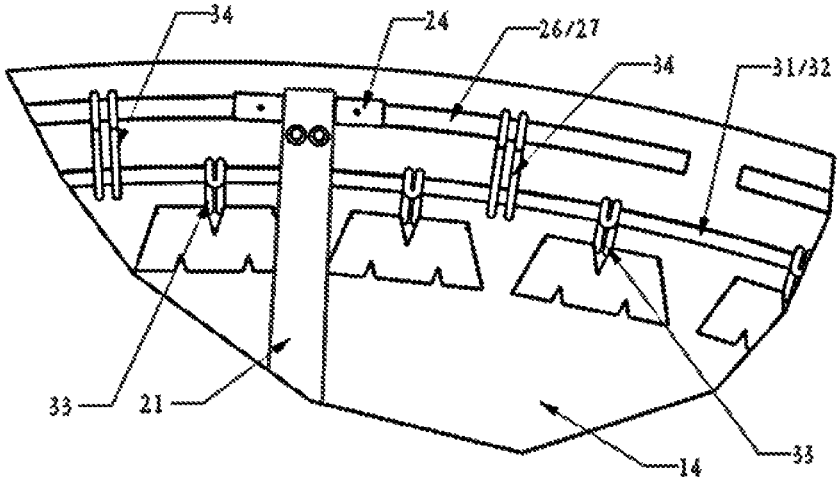
FIG. 9 is a plan of a section of the edge of the mat.
Figure 10:
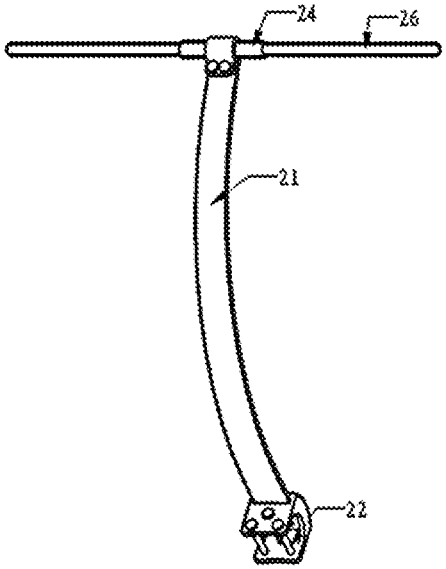
FIG. 10 is a pictorial representation of a leaf spring component of the trampoline of FIG. 1.

As can be seen in FIGS. 5 and 9, the sixteen fibreglass segments 26 together form an outer disconnected ring 27 about the mat with the ends of adjacent segment being slightly spaced apart. In other embodiments, the segments are slidably connected by plastic sleeves which allow sufficient relative movement towards and away from other to accommodate changes in diameter of the disconnected ring while a user is jumping on the mat.

A second disconnected ring 31 within ring 27 (previously described) is formed by another sixteen fibreglass rod segments 32 which are connected to the periphery of the mat 14 by wire hooks 33 in a manner similar to that in which the extension springs are connected to the mat in the known trampolines. The two rings are secured together by loop ties 34 formed of rubber or other suitable flexible and resilient material to form two generally concentric rings which at rest lie generally in the horizontal plane containing the mat.

A safety net 41 extends fully about the net 14 as can be seen in FIG. 1 and is secured to the mat at its lower edge 42 by circumferentially spaced "D" hooks which connect to the loops 33 provided at the periphery of the mat. The net is connected at its upper edge 46 to the upper end of circumferentially spaced posts 44. Advantageously, the safety net has a vinyl plastic border strip 47 along its lower edge with circumferentially spaced slits 48 provided therein and respective D hooks pass through the slits so as to secure the net thereto.

The posts 44 are formed of steel tube and a post is coupled to each leg mount by a pivot pin 51 for limited in and out pivoting movement relative to the mat about a horizontal axis against a leaf spring 52. The net posts are connected to the net at their upper ends by a packet 53. If desired, the safety net may be coupled to the posts intermediate the upper and lower edges by rubber straps or similar flexible and resilient ties and also may be connected to each other by a fibreglass ring of the same diameter as the mat.

Figure 39:
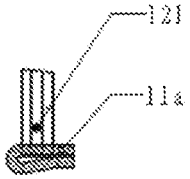
FIG. 39 is a blown up view of a portion of the leaf spring shown in FIG. 36 as Detail D.
Figure 40:
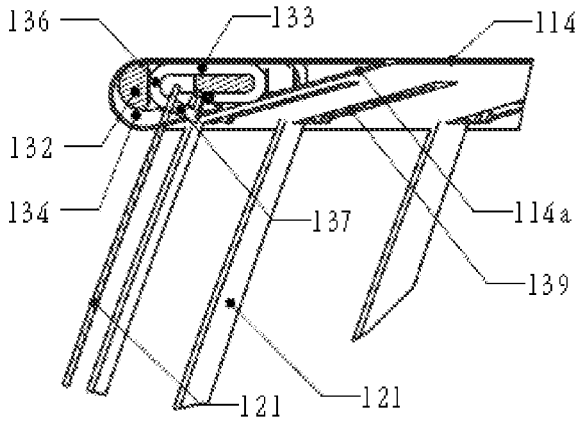
FIG. 40 is a blown up view of a portion of the leaf spring shown in FIG. 34 and its connection to the bottom frame shown as Detail E in FIG. 36.

The trampoline 110 is similar to the trampoline 10 illustrated in FIG. 1 in many respects and accordingly, the corresponding reference numbers will be used to reference corresponding components where possible except prefaced by a "1". The trampoline 110 illustrated in FIG. 14 includes a circular bottom frame 111 constructed of 65 mm round steel tube which is supported on eight short angularly spaced legs 112 each of which is connected to the frame by opposed leg mounts 113. In this example, the legs are not connected in pairs as with the trampoline of FIG. 1. While the bottom frame in the embodiment shown is circular in cross section, other shapes may also be used, for example, the cross sectional shape shown in FIG. 39 as 111*a*. Suitably, a jumping mat 114 is operatively connected to the frame 111 via forty equally angularly spaced plate like leaf springs 121 which extend upwardly and curve inwardly from the frame.

The leaf springs 121 pass through spaced apart slots 122 respectively which are formed in the bottom frame 111 and parallel to the curved longitudinal axis of the frame and are rigidly secured therein by virtue of a tight fit. The leaf springs are held in the slots by bolts or rivets 123 passing through the leaf springs immediately above and below the bottom frame respectively. However, if desired, the leaf springs could have a bend at their lower ends to prevent them lifting out of the slots under the jumping action of a user although it is believed that such an occurrence would be unlikely if not impossible.

Figure 32:
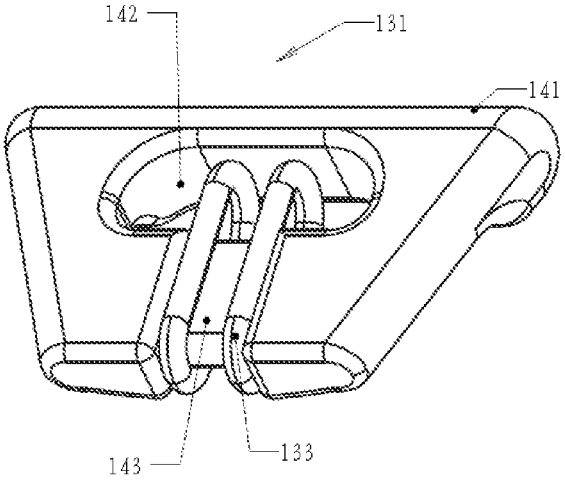
FIG. 32 is a pictorial representation of the mat hook of FIG. 30 and mat connector of FIG. 27 connected together for operation from above.
Figure 33:
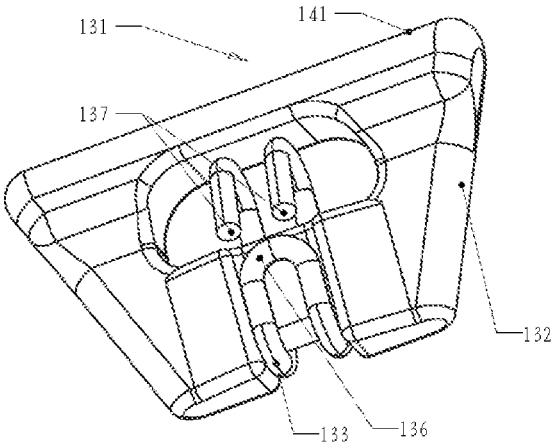
FIG. 33 is a pictorial representation of the mat hook of FIG. 30 and mat connector of FIG. 27 connected together for operation from below.
Figure 34:
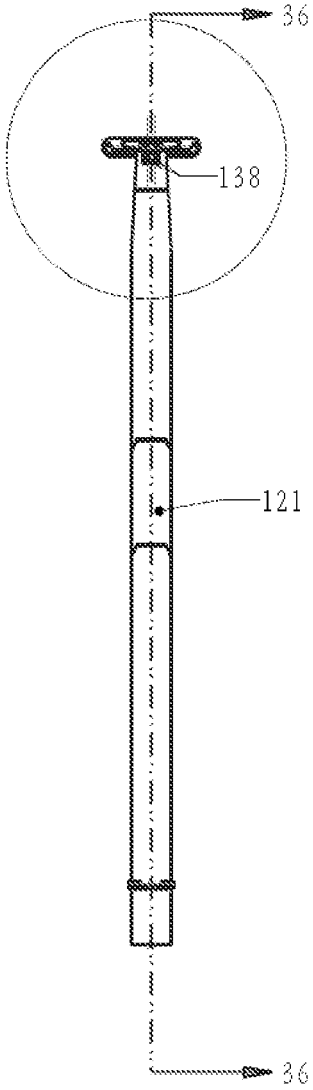
FIG. 34 is a front elevation of the leaf spring components of the trampoline shown in FIG. 14.
Figure 35:
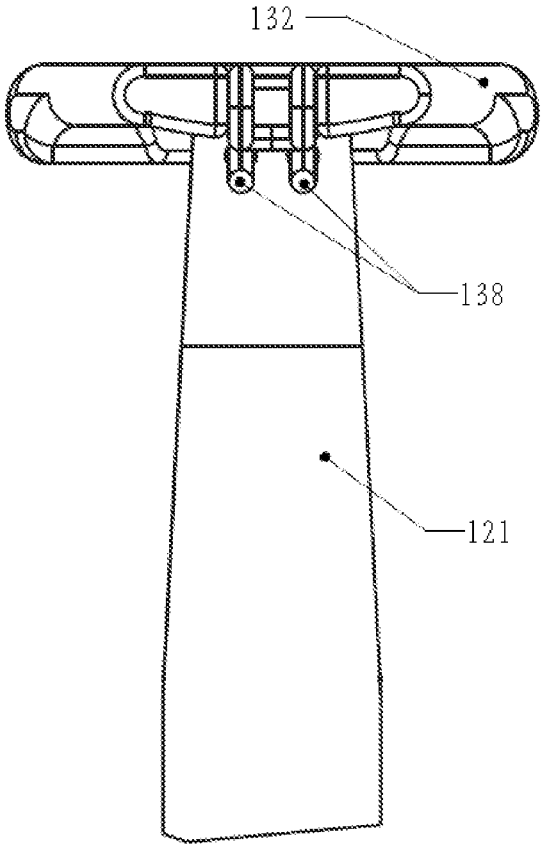
FIG. 35 is a blown up view of the upper end of the leaf spring shown in FIG. 34.
Figure 36:
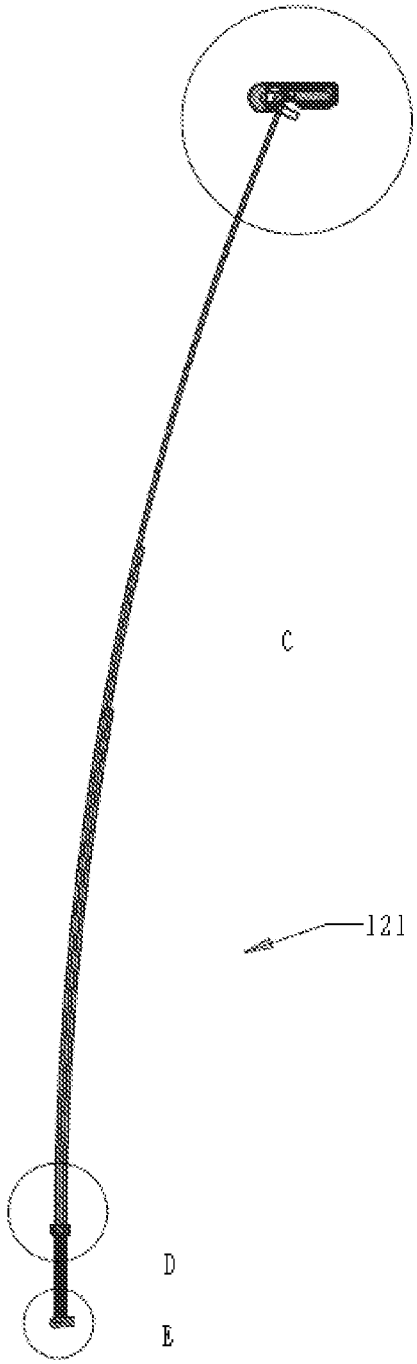
FIG. 36 is a side elevation of the leaf spring component of FIG. 12 along line 36-36.
Figure 37:
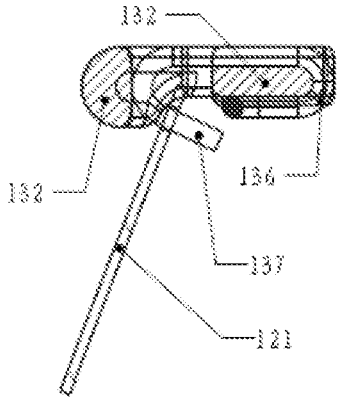
FIG. 37 is a blown up view of a portion of the mat connector component of the trampoline shown in FIG. 14 and its connection to the leaf spring shown as Detail C in FIG. 36.
Figure 38:
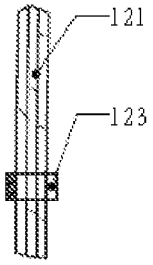
FIG. 38 is a blown up view of a portion of the mat connector component of the trampoline shown in FIG. 14 and its connection to the leaf spring shown as Detail C in FIG. 36 in a sectional pictorial view.

The mat 114 is connected at its periphery to the leaf springs 121 adjacent their upper ends by connector assemblies 131 as can be seen more clearly in FIGS. 32 and 33. Each connector assembly comprises a load bearing connector block 132 and a hook 133. The connector block 132 is adapted to engage in a circumferential pocket 134 formed at the periphery of the mat in a manner suitable for carrying the tensile load of the stretched mat. The hook 133 is a twin ended loop hook with the loop 136 hooking to the connector block and the free ends 137 both hooking to the leaf spring in side by side relation through two spaced apart holes 138 in the leaf spring as can be seen more clearly in FIG. 35.

The peripheral pocket is formed by folding the edge portion 114*a* of the mat under and stitching the folded portion to the underside of the mat 14 in known manner. Suitably, angularly spaced slots 139 are formed in the underside of the pocket to align with the leaf springs 121 respectively so that each leaf spring can extend into the pocket where it is connected to the mat via the hooks 133 and connector blocks 132.

As can be more clearly seen in FIGS. 32 and 33, the connector block is moulded from a plastics material and has a curved outer face 141 which is engaged by the mat and bears the tensile load of the mat thereagainst. A passage 142 is provided in the block and a recessed bridge 144 adjacent the passage forms a mount for attachment of the loop end 136 of the hook 133. Suitably, the passage 142 is adapted to accommodate the end portion of the leaf spring therein thus protecting the mat and users of the trampoline from injury.

Figure 14:
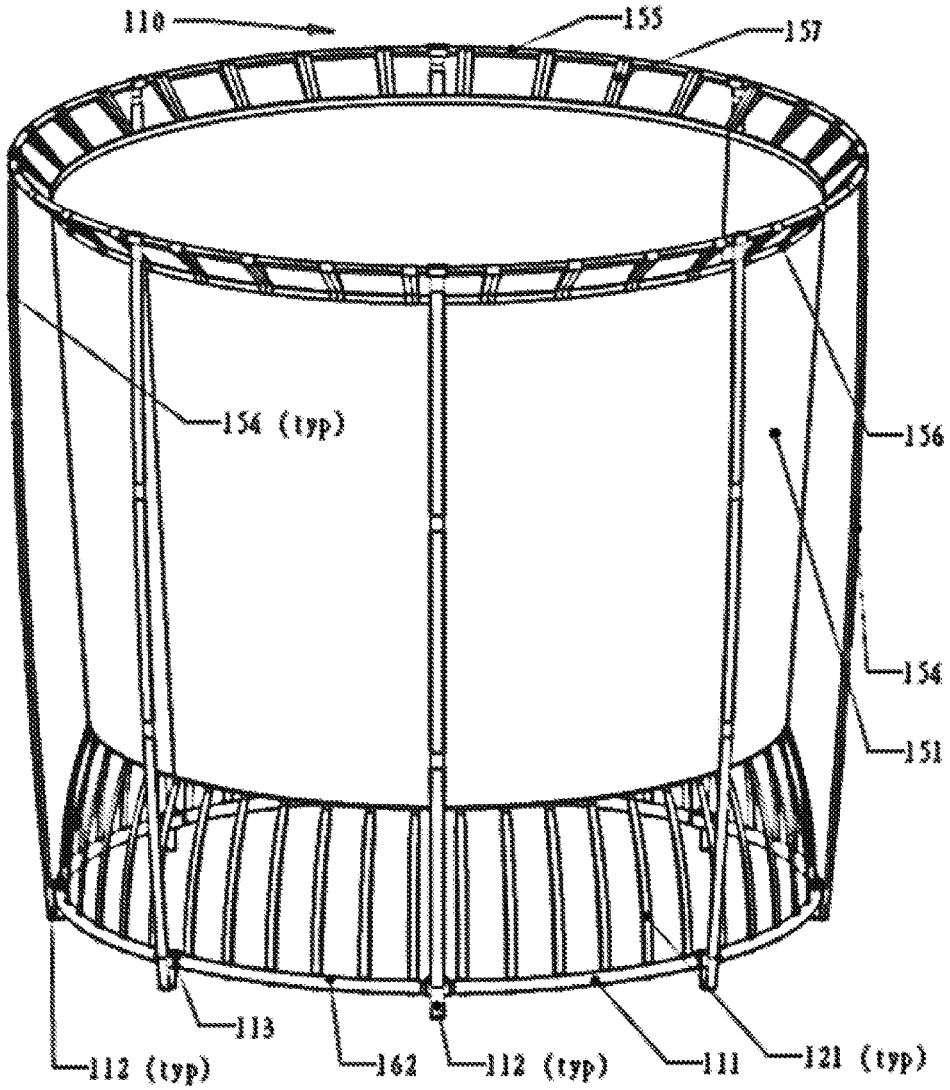
FIG. 14 is a pictorial representation of another trampoline according to the invention resting on a floor with a safety enclosure fitted.
Figure 15:
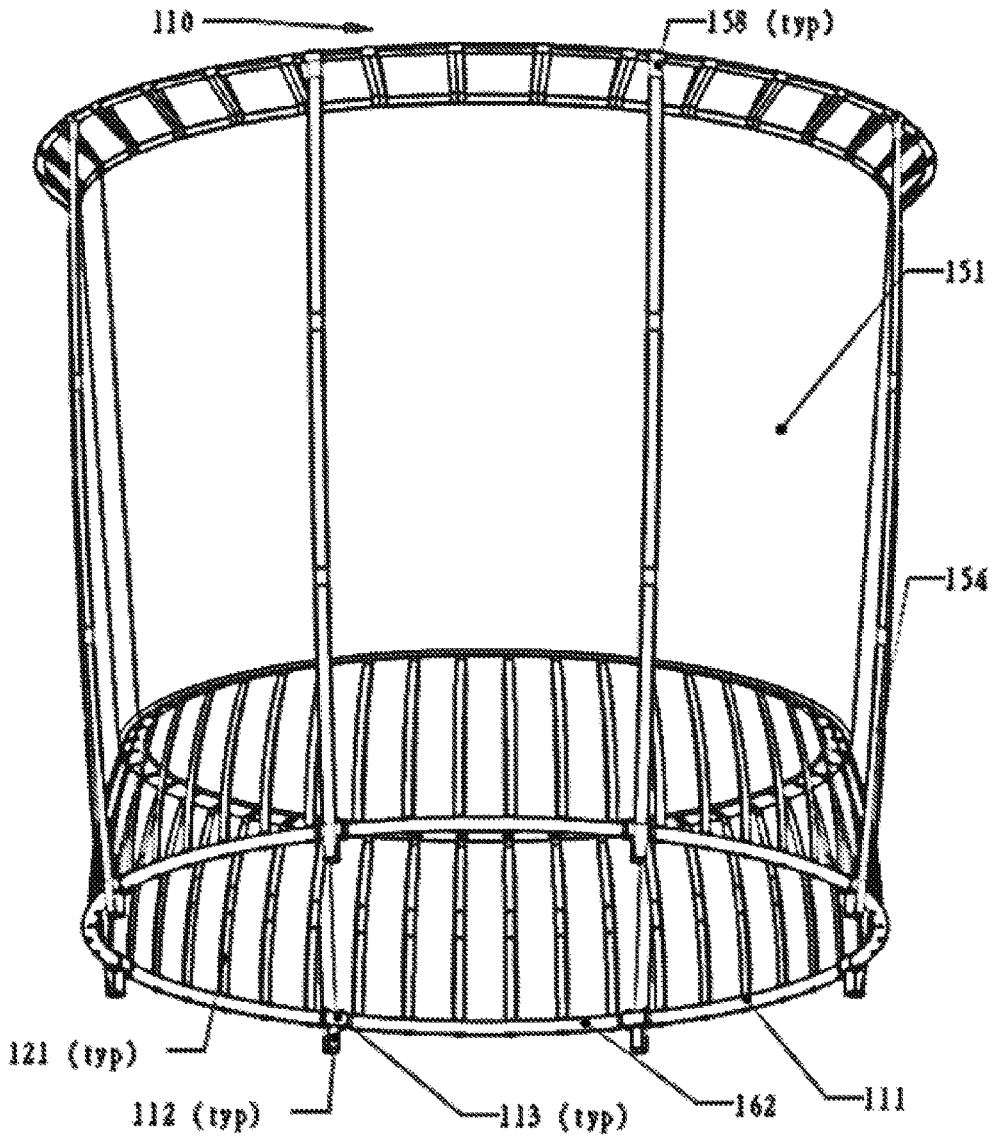
FIG. 15 is a pictorial representation of the trampoline of FIG. 14 tilted to show the underside.
Figure 16:
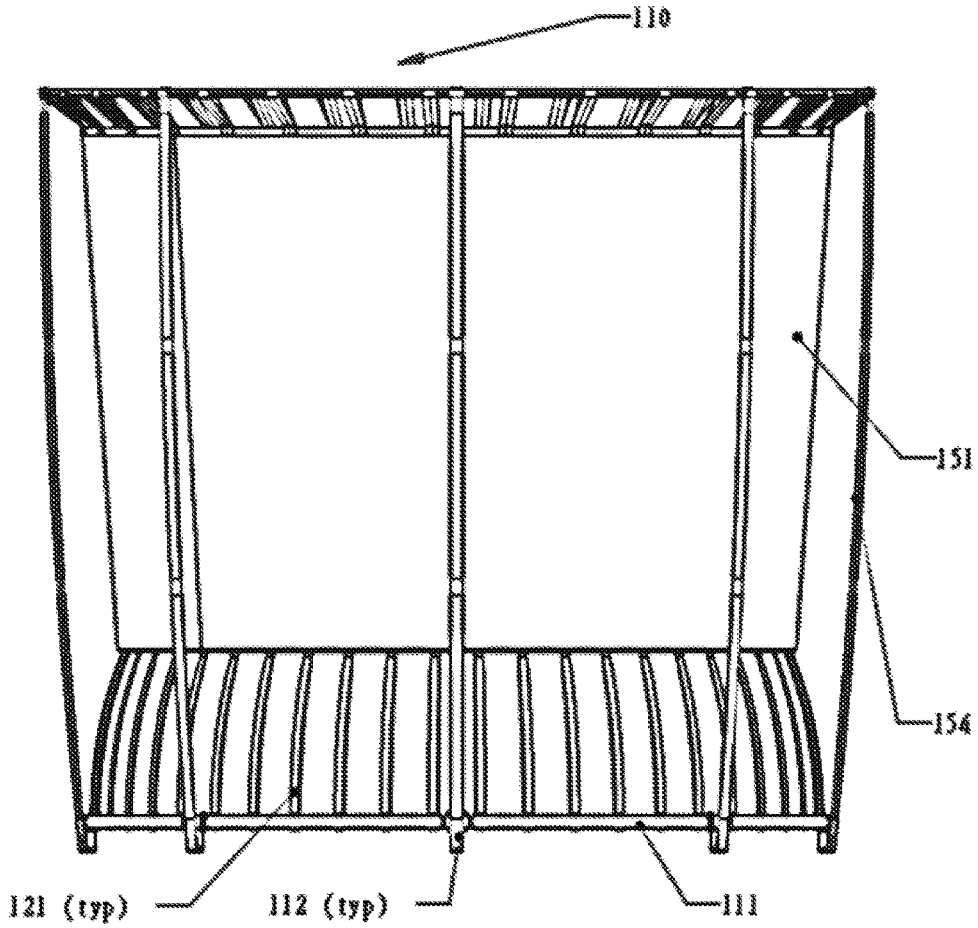
FIG. 16 is a front elevation of the trampoline of FIG. 14.
Figure 17:
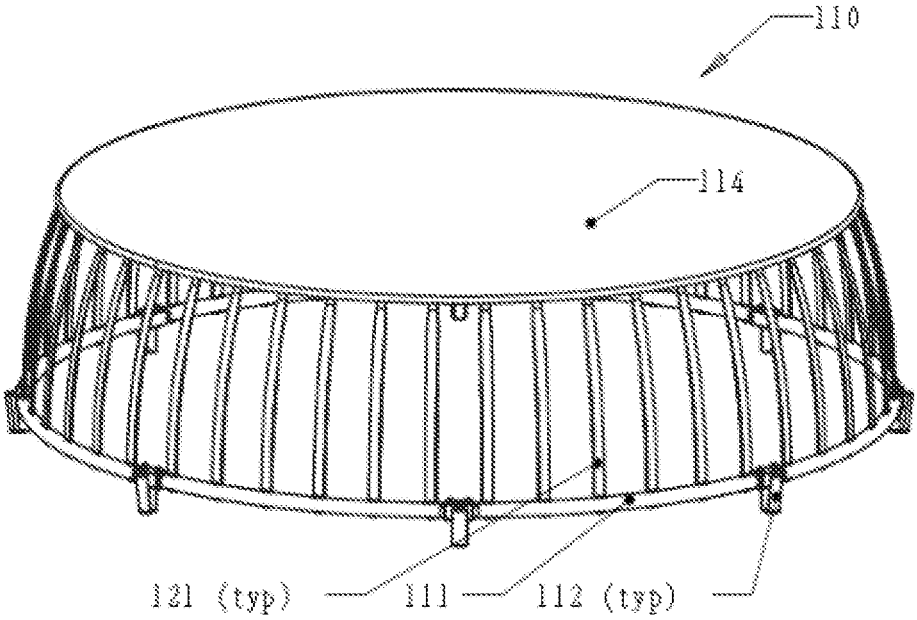
FIG. 17 is a pictorial representation of the trampoline of FIG. 14 with the safety not removed.
Figure 18:
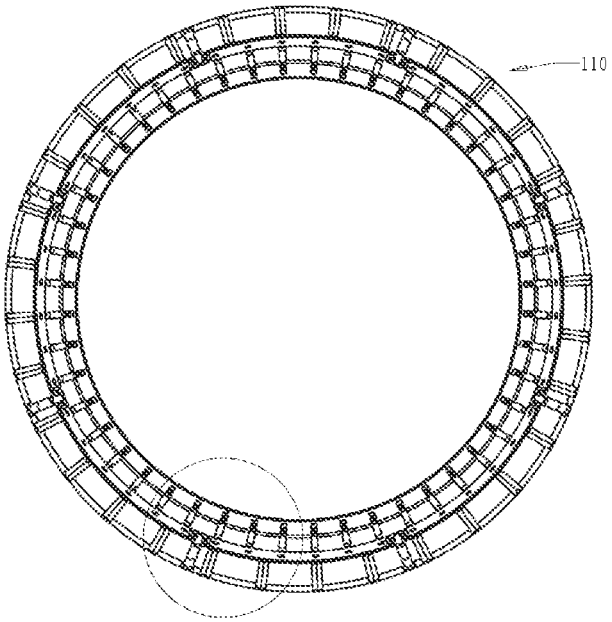
FIG. 18 is a plan of the trampoline of FIG. 14 with the safety net removed.
Figure 19:
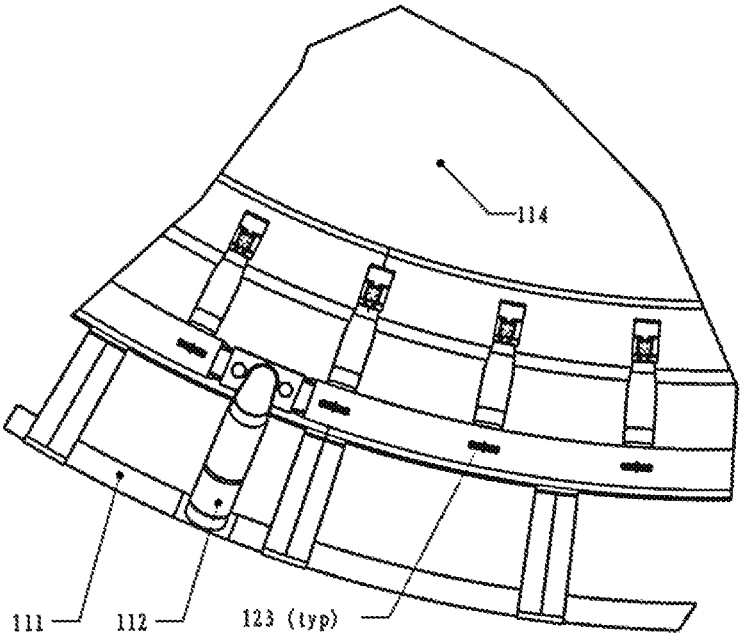
FIG. 19 is a blown up view of a peripheral portion of the trampoline of FIG. 14 with the safety net removed.
Figure 20:
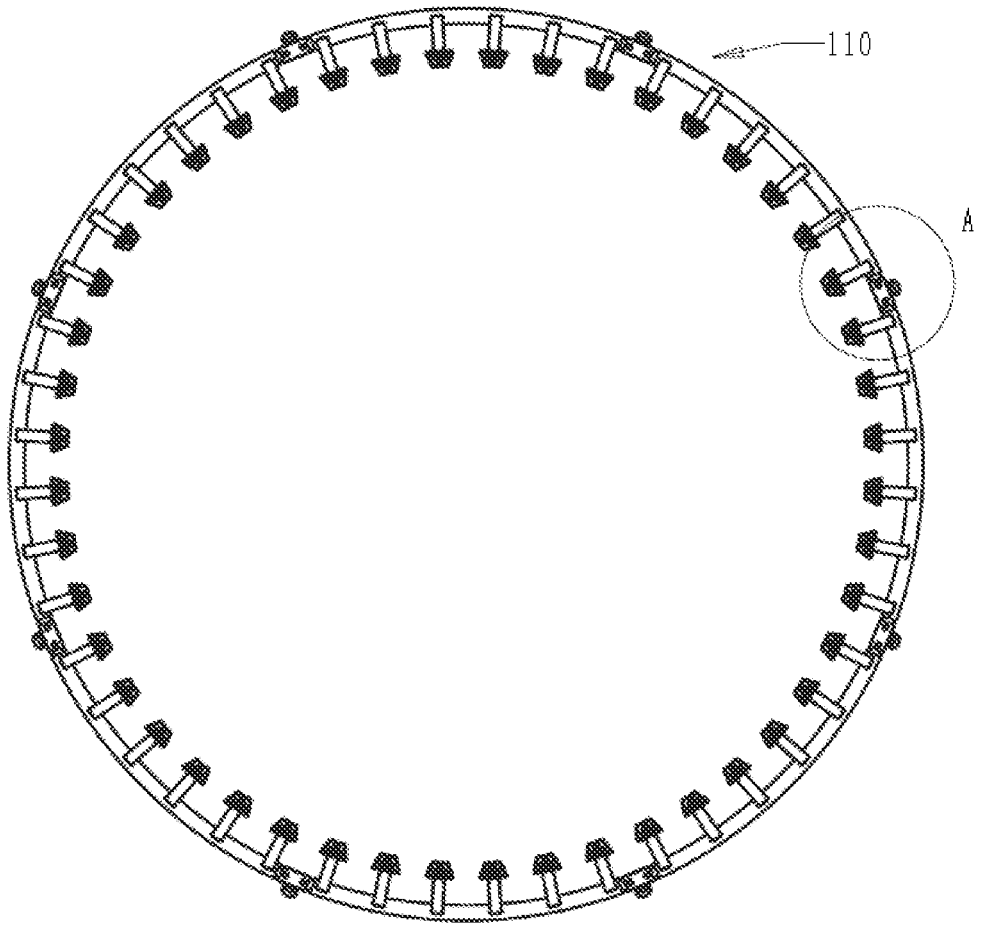
FIG. 20 is a top plan of the trampoline of FIG. 14 with the safety enclosure removed.
Figure 21:
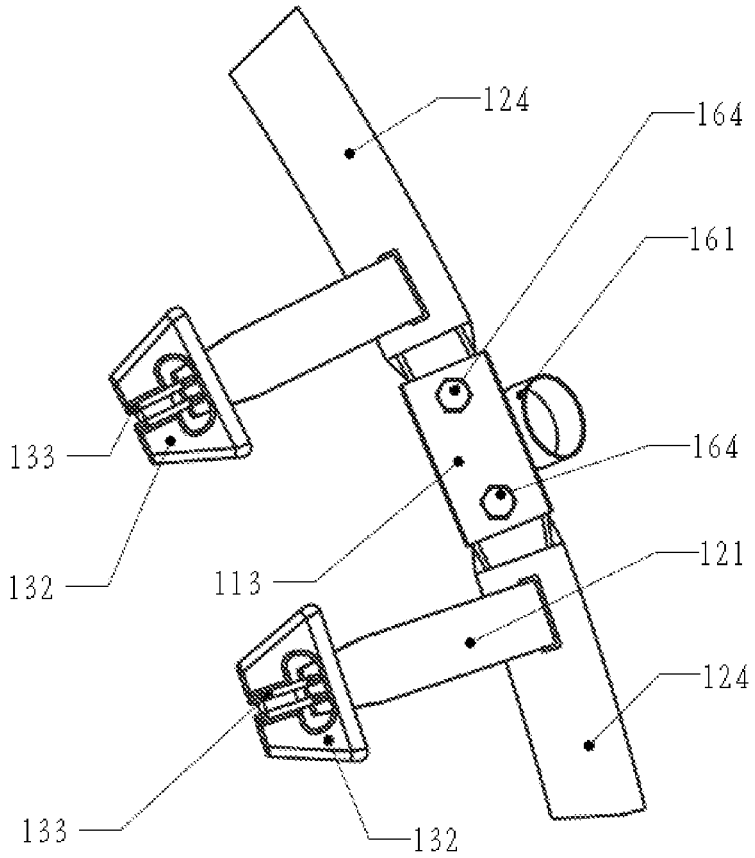
FIG. 21 is a blown up top plan of a portion of the trampoline shown in FIG. 20 as Detail A.
Figure 22:
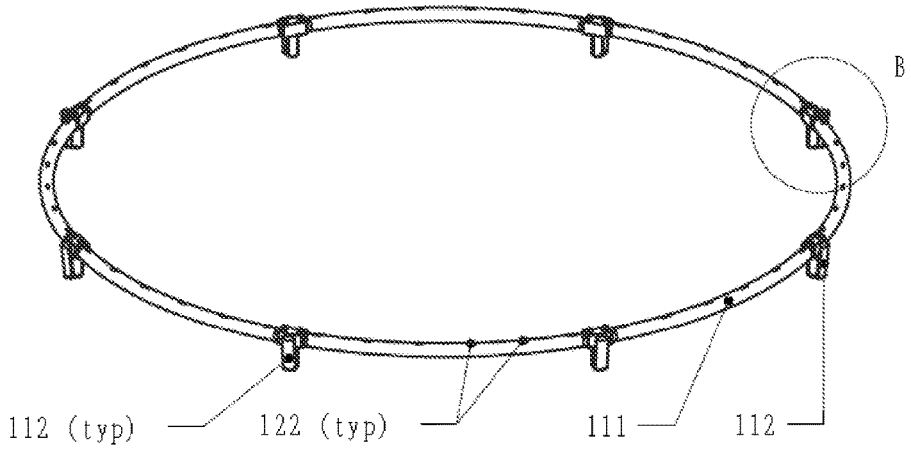
FIG. 22 is a pictorial representation of the bottom frame of the trampoline of FIG. 14.

A safety net 151 extends fully about the mat 114 as can be seen in FIG. 14 and is secured to the mat at its lower edge 152 by circumferentially spaced "D" hooks which connect to the hooks 133 at the periphery of the mat. The net is connected at its upper edge 156 to a circular ring 155 of approximately the same diameter as the bottom frame and is supported by spaced apart posts 154 via clamps 158.

The posts 154 are formed of steel tube and the posts are slidably engaged in sleeves 161 which in turn are rigidly connected to the legs 112 thereby forming a rigid safety frame to which the safety net can be flexibly connected. If desired, the safety net may be coupled to the posts intermediate the upper and lower edges by rubber straps or similar flexible and resilient ties and also may be connected to each other by a fibreglass ring of the same diameter as the mat.

Figure 23:
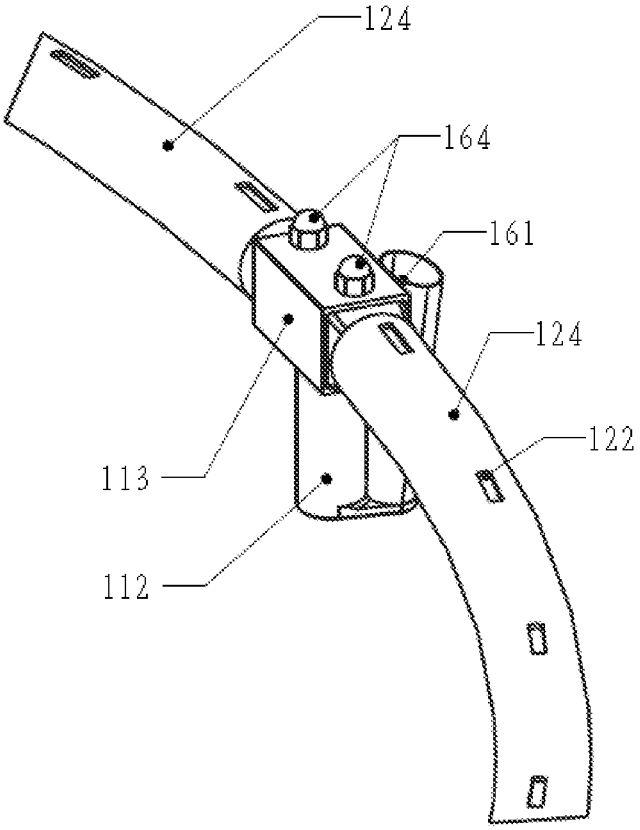
FIG. 23 is a blown up view of a portion of the trampoline shown in FIG. 22 as Detail B.
Figure 24:
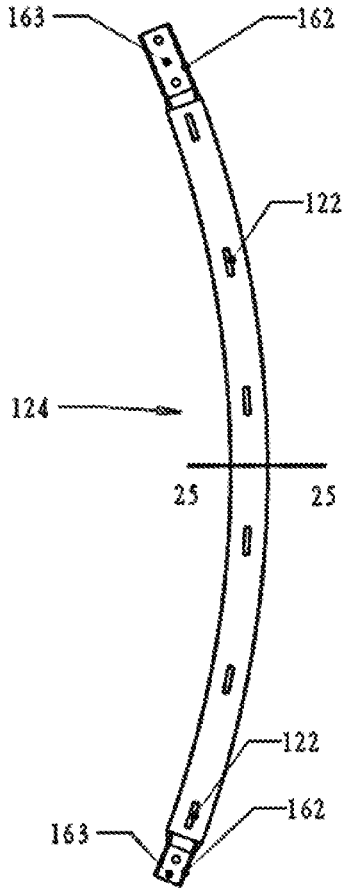
FIG. 24 is a plan of a segment of the bottom frame shown in FIG. 22.
Figure 25:
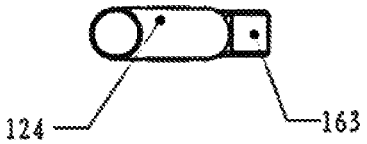
FIG. 25 is a sectional representation of the segment shown in FIG. 24 along Line 25-25.
Figure 26:
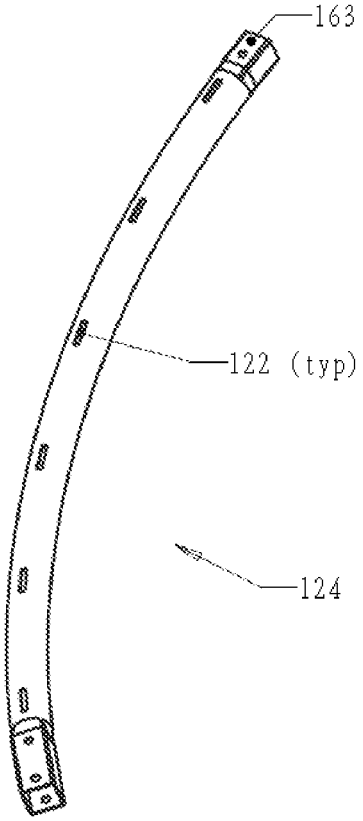
FIG. 26 is a pictorial representation of the segment shown in FIG. 24.
Figure 27:
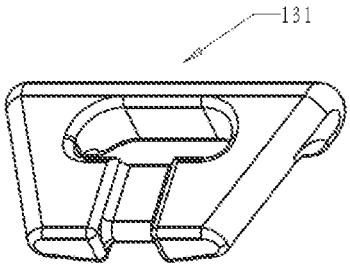
FIG. 27 is a pictorial representation of the mat connector of the trampoline of FIG. 14.
Figure 28:
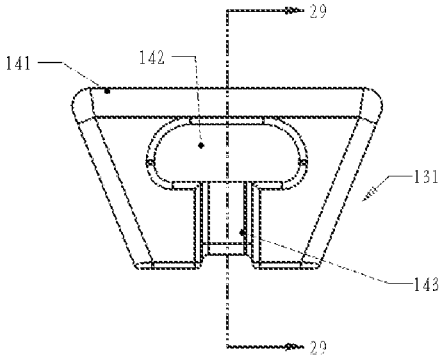
FIG. 28 is a plan of the mat connector shown in FIG. 27.
Figure 29:
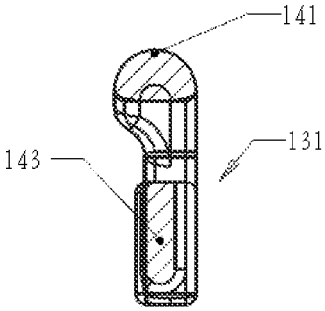
FIG. 29 is a sectional elevation of the mat connector shown in FIG. 27 along line 29-29.
Figure 30:
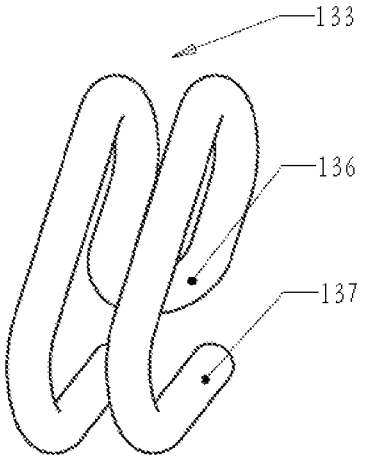
FIG. 30 is a pictorial representation of the mat hook of the trampoline of FIG. 14.
Figure 31:
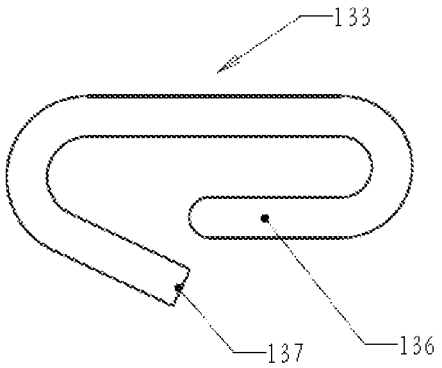
FIG. 31 is a side elevation of the mat hook shown in FIG. 30.

As can be seen more clearly in FIGS. 23 to 26, the bottom frame comprises interconnected tubular segments 124 of generally circular cross section. However, the end portions of the segments are formed with a generally square cross section shown at 162 and have keying recesses 163 formed therein. Advantageously, the end portions are shaped to tightly engage in the square cross sectioned leg mounts 113 thereby inhibiting relative rotation between frame segments. As can be seen in FIG. 23 adjacent frame segments are bolted to the leg mounts 113 by bolts 164.

Figure 41:
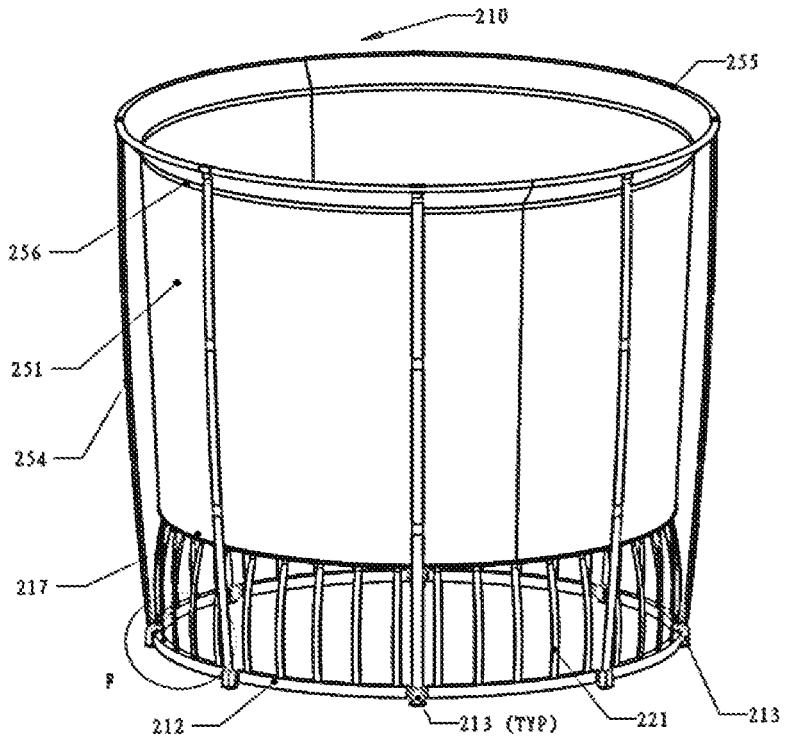
FIG. 41 is a pictorial representation of another trampoline according to the invention resting on a floor with a safety enclosure fitted.
Figure 42:
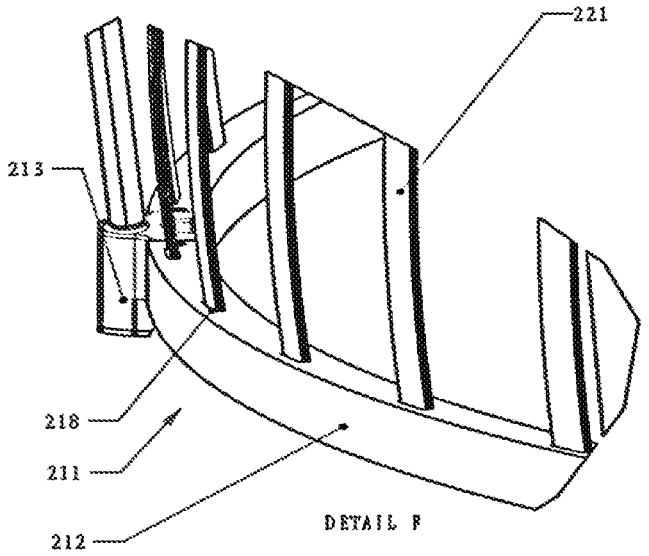
FIG. 42 is a blown up portion of part of the trampoline shown in FIG. 41 as Detail F.
Figure 43:
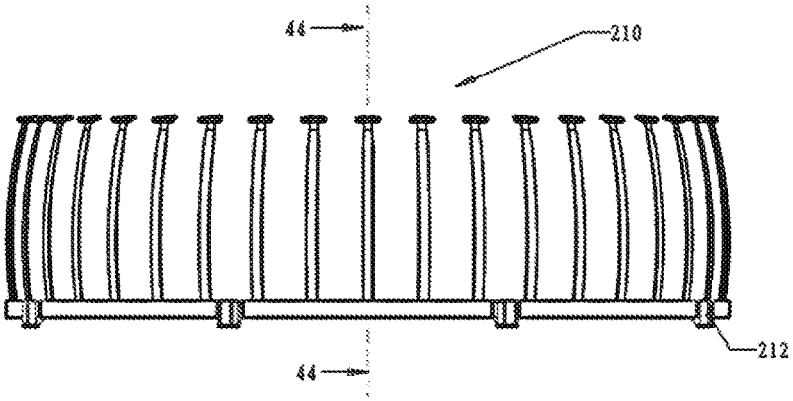
FIG. 43 is a pictorial representation of the trampoline of FIG. 41 with the safety enclosure and mat removed for Clarity.
Figure 44:
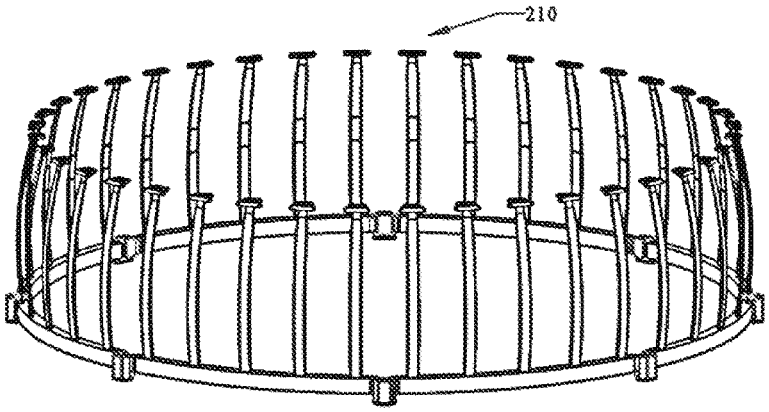
FIG. 44 is a front elevation of the trampoline of FIG. 1 with the safety enclosure and mat removed for clarity.
Figure 45:
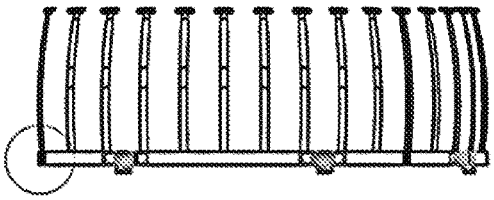
FIG. 45 is a sectional side elevation of the trampoline of FIG. 41 with the safety enclosure and mat removed for clarity.
Figure 46:
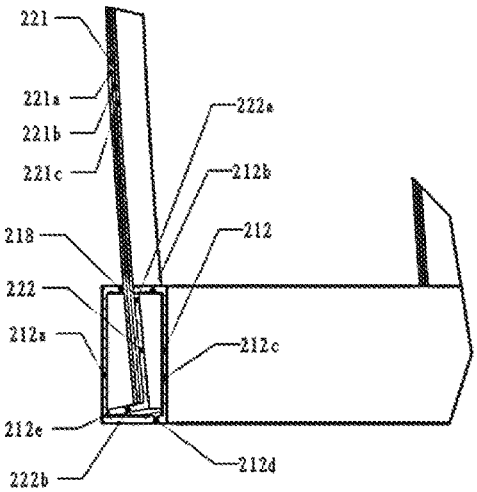
FIG. 46 is a blown up portion of part of the trampoline shown in FIG. 41 as Detail G.
Figure 47:
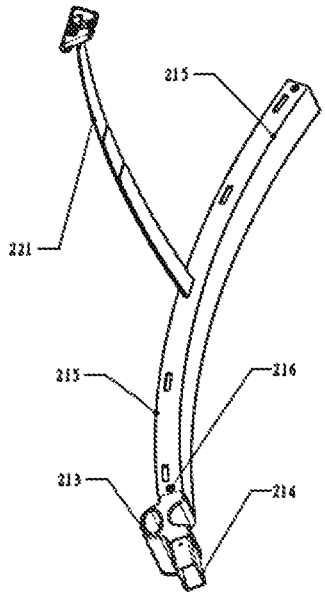
FIG. 47 is a pictorial representation of a segment of the bottom frame of the trampoline of FIG. 41 with a leaf spring mounted thereto.
Figure 48:
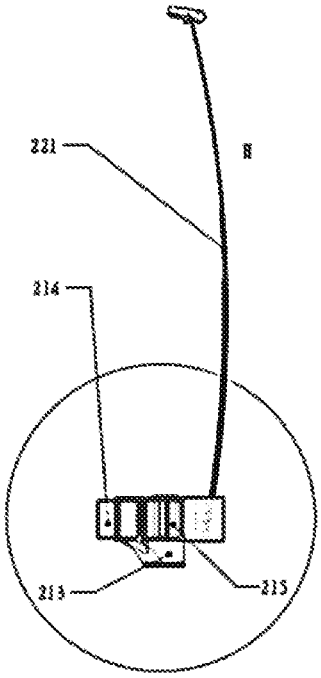
FIG. 48 is a sectional end elevation of the segment of the bottom frame shown in FIG. 7.
Figure 49:
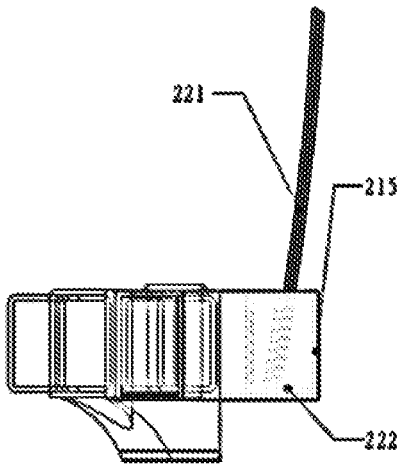
FIG. 49 is a blown up portion of part of the segment shown in FIG. 47 through the leaf spring marked as Detail H.

The trampoline 210 illustrated in FIG. 41 is also similar to the trampolines 10 and 110 illustrated in earlier drawings in many respects. Accordingly, the same reference numbers will be used to reference corresponding components as far as possible except prefaced by a "2".

The trampoline 210 also includes a circular bottom frame 211 comprising eight arcuate segments 212 as in the earlier drawings but in this embodiment the segments are constructed of rectangular hollow section steel tube. The segments are supported on eight short angularly spaced legs or feet 213. Each leg 213 includes opposed outwardly extending stub tubes 214 which are suitably sized to receive thereover the end portions of tubular frame segments 215 which slide thereon and are secured by vertical bolts 216.

The bottom frame in this embodiment is rectangular in cross section comprising outside wall 212*a*, bottom wall 212*b*, inside wall 212*c* and bottom wall 212*d* with the short sides horizontal and the long sides vertical. However, square section tube would also be satisfactory and perhaps even polygonal shaped tubes.

Suitably, a jumping mat 217 (hidden) is operatively connected to the bottom frame 11 via forty equally angularly spaced leaf springs 221 which extend upwardly and curve inwardly from the frame in much the same manner as for trampoline 110 illustrated in earlier drawings. Advantageously, spaced apart slots 218 are cut or punched in the upper wall 212*b* of the bottom frame for mounting the leaf springs thereto as will be described below.

Each leaf spring comprises three laminated spring steel plates of equal thickness with three layers, 221*a*, 221*b* and 221*c* at the bottom end reducing to two layers, 221*a* and 221*b* in the mid-section and only one layer 221*a* nearer the top. At the bottom end, a foot 222 formed or unequal flange angle iron is welded to layer 221*c* so that its long flange 222*a* rests against the outer face of layer 221*c* and its short flange 222*b* is under the bottom end of the leaf spring providing a toe 222*c* which is arranged to engage the inside bottom corner 212*e* of the steel tube adjacent its outer wall 212*a* while the tip 222*d* of the long flange engages the inner face of the top wall 212*d* of the steel tube adjacent slot 218 thereby preventing the leaf spring from escaping from the slot when in operation because the tension applied by the mat to the upper end of the leaf spring holds the toe in engagement with the tube and that in turn holds the tip under the upper wall of the tube.

A safety net 251 extends fully about the mat as can be seen in FIG. 41 and is secured in the same manner as described in relation to trampoline 110 as shown in FIG. 14.

Figure 50:
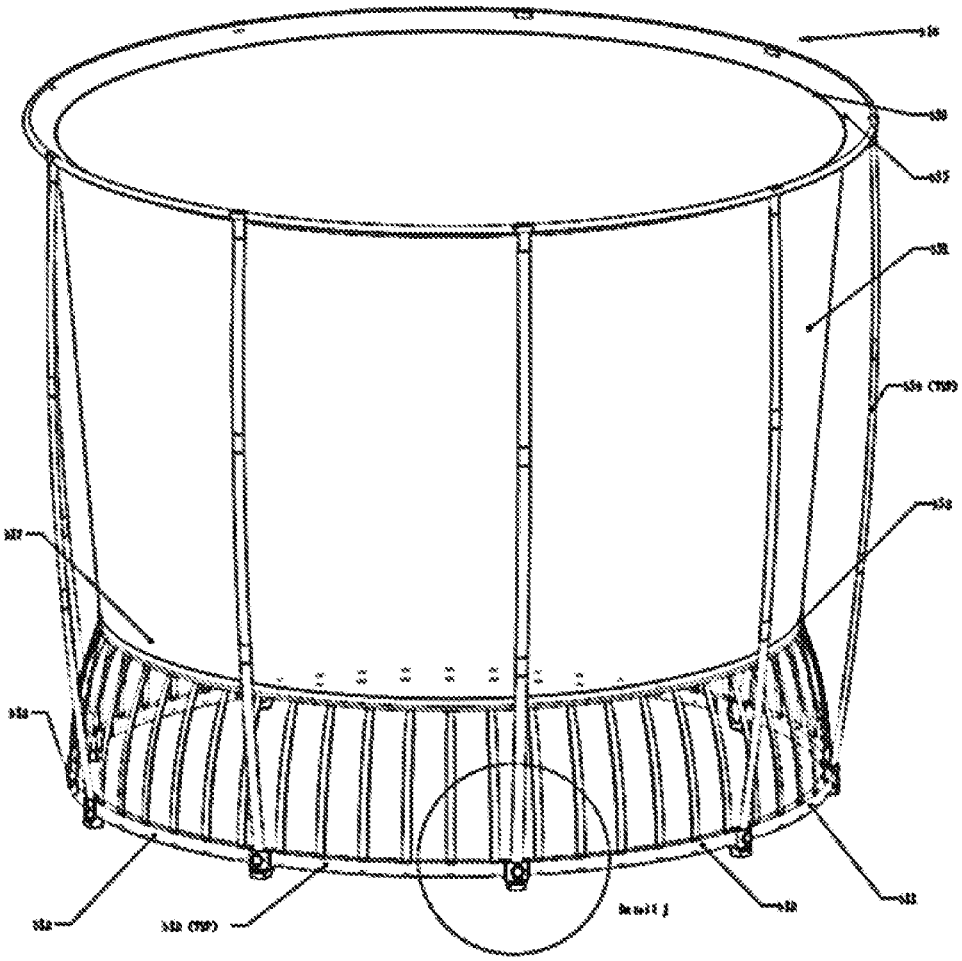
FIG. 50 is a pictorial representation of another trampoline according to the invention resting on a floor with a safety enclosure fitted.
Figure 51:
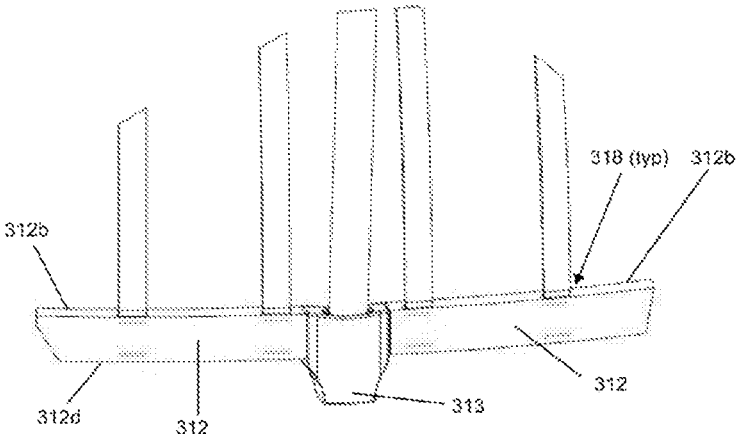
FIG. 51 is a blown up drawing of part of the trampoline shown in FIG. 50 as Detail J.

The trampoline 310 illustrated in FIG. 50 is similar to the trampolines 10, 110 and 210 previously described in many respects and accordingly the same reference numbers will be used to reference corresponding components where possible except prefaced by a "3". The trampoline 310 includes a circular bottom frame 11 comprising eight arcuate segments 312 constructed of rectangular hollow section steel tube which are connected to each other by cast alloy segment connectors 313 each of which has a foot portion arranged to support the connector and the frame immediately above the ground as will be described in more detail later. Each connector 313 includes opposed outwardly extending arm like members 314 which are suitably sized to receive thereover the end portions of tubular frame segments 312 which slide thereon and are secured by pairs of vertically spaced apart horizontal bolts 316 which extend radially outwards.

The bottom frame in the embodiment shown is rectangular in cross section comprising outside wall 312*a*, bottom wall 312*b*, inside wall 312*c* (not visible) and bottom wall 312*d* with the short sides horizontal and the long sides vertical. A jumping mat 317 is operatively connected to the bottom frame 311 via fifty-four equally angularly spaced leaf springs 321 which extend upwardly and curve inwardly from the frame 311, each leaf spring being securely engaged in respective slots provided in the upper wall of the bottom frame in much the same manner as for the trampoline 210 illustrated in FIG. 41 and a safety net 351 extends fully about the mat in the same manner and is secured to the mat at its lower edge 352 by circumferentially spaced "D" hooks which connect to the hooks 333 at the periphery of the mat. The net is connected at its upper edge 356 to a circular ring 355 of approximately the same diameter as the bottom frame and is supported by spaced apart posts 354.

In this embodiment, the segment connectors 313 are formed of cast aluminium alloy but in other embodiments they are formed of cast iron or cast steel but any other suitable material capable of withstanding the torsion applied thereto by the leaf springs 321 could be used if desired. Suitably, each leg connector has a centre portion 371 which is shaped to provide a foot 372 having a bottom face 372*a* adapted to rest on the ground. Advantageously, the bottom face is curved slightly in the in-use radial direction (shown as arrows A and B) to accommodate slight twisting of the frame segments 312 during operation of the jumping mat.

Figure 52:
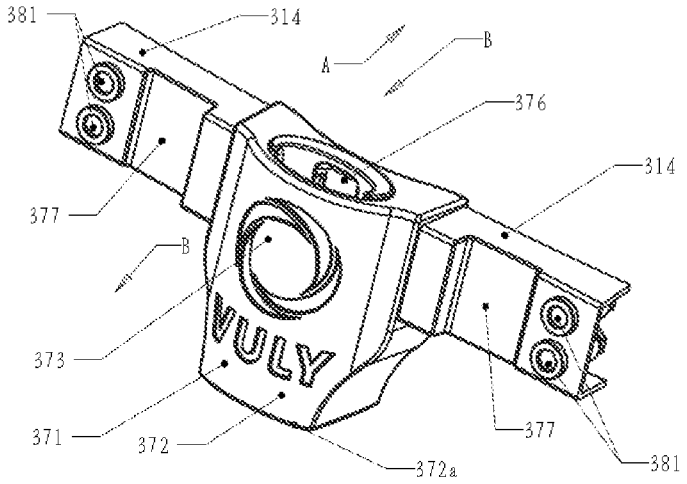
FIG. 52 is a pictorial representation of one of the frame segment connector which connect the base frame segments of the trampoline of FIG. 50 from the outside.
Figure 53:
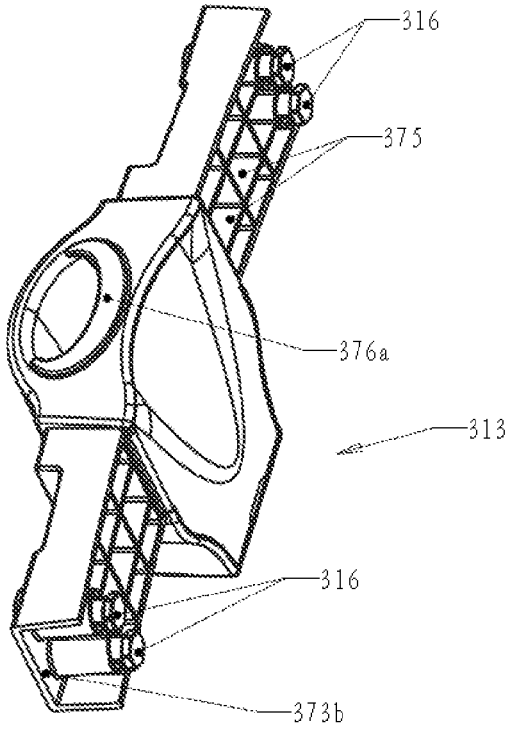
FIG. 53 is a pictorial representation of the frame segment connector of FIG. 50 from the inside.
Figure 54:
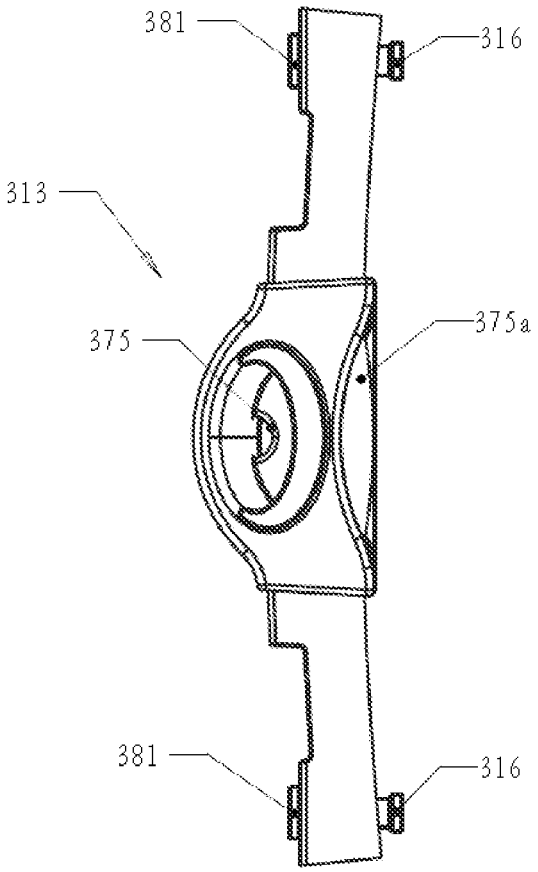
FIG. 54 is a plan of the connector of FIG. 52.
Figure 55:
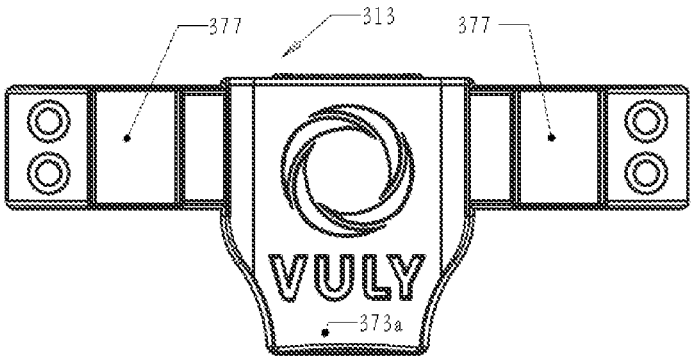
FIG. 55 is an outside elevation of the connector of FIG. 52.
Figure 56:
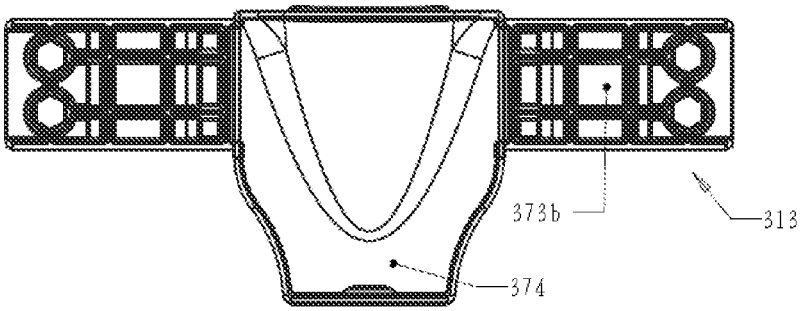
FIG. 56 is an inside elevation of the connector of FIG. 52.
Figure 57:
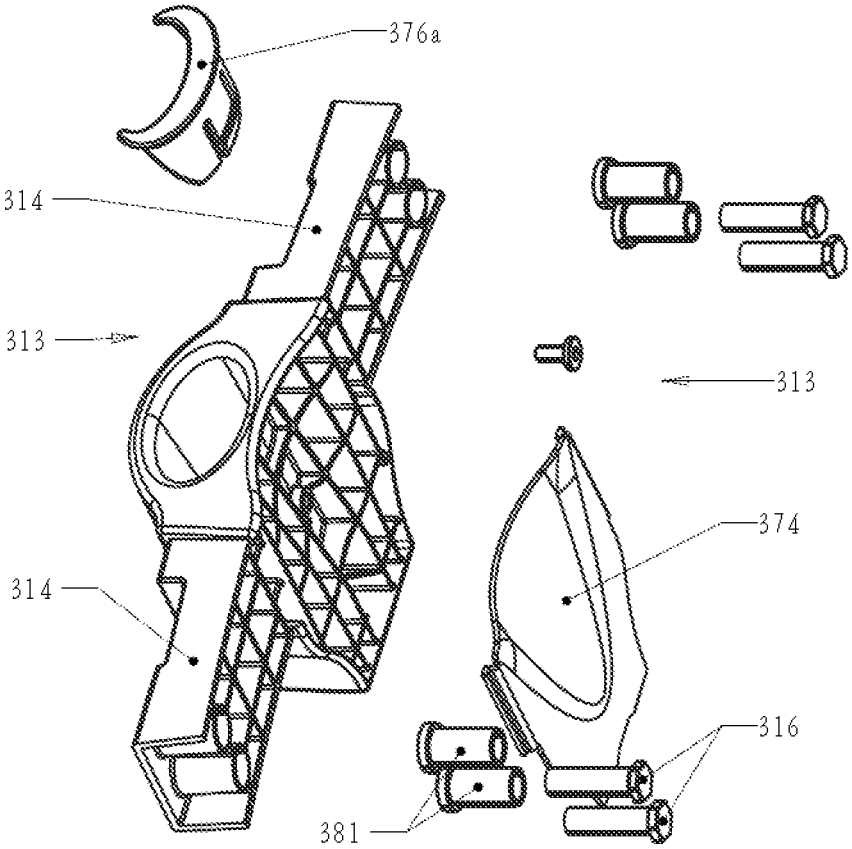
FIG. 57 is a pictorial representation of the frame segment connector of rig. 52 disassembled.
Figure 58:
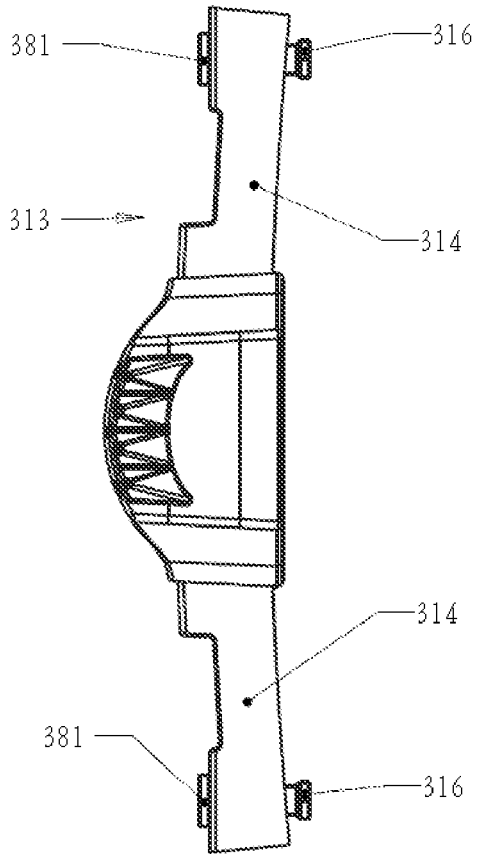
FIG. 58 is a bottom plan of the frame segment connector of FIG. 52.
Figure 59:
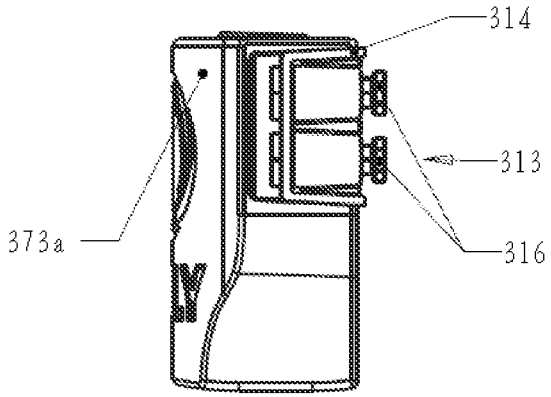
FIG. 59 is an end elevation of the frame segment connector of FIG. 52.

As can be seen more clearly in FIG. 52, the connector 313 has a solid front wall 373 having a front face 373*a* and a rear face 373*b* from which a plurality of interconnected ribs or webs 375 extend rearwards (radially inwards in use) to terminate in an open face 375*a* the centre portion of which is closed by a cast alloy clip on cover 374.

Advantageously, an elongate cavity 376 of generally elliptical cross section is provided in the centre portion 371 for receiving therein the lower end portion of a safety net pole 354. Suitably, a grub screw is screwthreadedly mounted in the webbed centre portion and arranged to engage with the pole to secure it in the cavity and is covered from view by the clip-on cover 374. In order to prevent accumulation of water in the cavity, the passage is drained via an opening 375 formed in the rib on which the pole rests and a flexible plastics cover 376*a* is provided to substantially close the gap about the pole to inhibit ingress of rain. Suitably, the ribbed open face of the two opposed arms 314 are covered by the adjacent frame segments when secured in position.

A recess 377 is formed in each arm for accommodating the bottom end portion of a leaf spring 321 which extends through the slot 318 formed in the upper wall 312*b* of the adjacent frame segment as described in relation to trampoline 210 and into the recess slot 377. Suitably, the recess 377 allows for a loose fit so that the leaf spring can be fitted to its desired position.

The frame segment on each side of the connector is secured to the connector by two bolts 316 as previously mentioned with each bolt being screwed into a threaded bush 381 which is tapered and adapted to engage in a complementary tapered bore 382.

Advantageously, the connector 313 provides an efficient and effective means of connecting frame segments so as to inhibit undesirable twisting while at the same time providing a suitable mount for the safety net. The connector also provides a means of cost effectively connecting shorter segments with a foot member so that twisting of frame segments can be reduced.

While the invention has been described in detail in respect of a circular trampoline base frame, it will be appreciated that it could be used for trampolines of other shapes such as ovaloid, elliptical, polygonal particularly square and rectangular The foregoing description has been given by way of illustrative example of the invention and many modifications and variations which will be apparent to persons skilled in the art may be made without departing from the spirit and scope of the invention as defined by the appended claim.

The invention claimed is:

1. A trampoline including:

a frame forming a substantially continuous horizontal ring adapted to rest on the ground on spaced apart legs, said frame including a plurality of segments of hollow section tube with adjacent segments connected end to end by separate frame segment connectors to form said substantially continuous horizontal ring;

a plurality of spaced apart flexible and resilient plates each having an upper free end and a lower free end connected to said frame at or adjacent their lower free ends against undesired relative movement between each flexible and resilient plate and said frame;

wherein said frame segment connectors include a frame support portion adapted to form said spaced apart legs, and two opposed frame segment engagement portions extending sideways from opposite sides of said frame support portion and engaged in the hollow of adjacent frame segments to be connected, each of said frame segment engagement portions having an outer end and a recess between said outer end and said frame support portion, and each of said segments of hollow section tube having a slot adjacent their opposite ends; and wherein a portion of one of said flexible and resilient plates adjacent its lower free end extends through one of said slots and is engaged in one of said recesses to secure a frame segment to said frame segment connector.

2. A trampoline according to claim 1 wherein said recess opens to an inner face of said hollow section tube segments and said inner face together with said recess define a passage and said portion of said flexible and resilient plate is engaged in said passage.

3. A trampoline according to claim 1, wherein said frame segment connectors also include fastening means for fastening said frame segments to said frame segment connectors.

4. A trampoline according to claim 3 wherein said fastening means include a threaded bores adapted to screwthreadedly receive therein bolts extending through aligned holes in the adjacent frame segments.

5. A trampoline according to claim 4 wherein said threaded bores are adjacent said outer ends of said frame segment engagement portions respectively and said recesses are between said threaded bores and said frame support portion.

* * * * *